US010065445B2

(12) United States Patent
Miyata et al.

(10) Patent No.: US 10,065,445 B2
(45) Date of Patent: Sep. 4, 2018

(54) BINDING COMPONENT

(71) Applicant: MAX CO., LTD., Tokyo (JP)

(72) Inventors: Takahiro Miyata, Tokyo (JP); Mitsuhiro Kimura, Tokyo (JP)

(73) Assignee: MAX CO., LTD., Tokyo (JP)

( * ) Notice: Subject to any disclaimer, the term of this patent is extended or adjusted under 35 U.S.C. 154(b) by 109 days.

(21) Appl. No.: 14/690,766

(22) Filed: Apr. 20, 2015

(65) Prior Publication Data

US 2015/0298486 A1 Oct. 22, 2015

(30) Foreign Application Priority Data

Apr. 21, 2014 (JP) ..... 2014-087252

(51) Int. Cl.

| | |
|---|---|
| ***B42F 3/00*** | (2006.01) |
| ***B42F 13/40*** | (2006.01) |
| ***B42F 13/02*** | (2006.01) |
| ***B42F 3/02*** | (2006.01) |
| ***B42F 13/00*** | (2006.01) |
| ***B42F 13/20*** | (2006.01) |
| ***B42F 13/22*** | (2006.01) |
| ***B42B 5/10*** | (2006.01) |
| ***B42F 13/16*** | (2006.01) |
| ***B42F 13/26*** | (2006.01) |
| *B42C 1/12* | (2006.01) |

(52) U.S. Cl.

CPC ..... *B42F 13/22* (2013.01); *B42B 5/10* (2013.01); *B42B 5/103* (2013.01); *B42F 13/165* (2013.01); *B42F 13/26* (2013.01); *B42C 1/12* (2013.01)

(58) Field of Classification Search

CPC .. B42F 3/00; B42F 13/40; B42F 13/02; B42F 13/06; B42F 3/02; B42F 13/00; B42F 3/04

USPC ..... 402/5, 8, 19, 20, 26, 31, 36, 39, 44

See application file for complete search history.

(56) References Cited

U.S. PATENT DOCUMENTS

| | | | |
|---|---|---|---|
| 2005/0271459 | A1 | 12/2005 | To et al. |
| 2007/0134052 | A1 | 6/2007 | Nelsen et al. |
| 2008/0310909 | A1 | 12/2008 | Park |

(Continued)

FOREIGN PATENT DOCUMENTS

| | | | |
|---|---|---|---|
| CA | 2 319 369 | A1 | 8/1999 |
| EP | 1655146 | A1 | 5/2006 |
| EP | 1908602 | A1 | 4/2008 |

(Continued)

*Primary Examiner* — Justin V Lewis

(74) *Attorney, Agent, or Firm* — Drinker Biddle & Reath LLP

(57) ABSTRACT

A binding component includes ring back portions, first ring arm portions, second ring arm portions and a back part to which the ring back portions are connected. Each ring back portion, each first ring arm portion and each second ring arm portion forms an annular ring part. Each ring part includes fitting portions at places where the ring back portion and the first and second ring arm portions are connected. The fitting portions are configured to be fitted by an operation of opening and closing the first and second ring arm portions with hinge portions of the ring back portion. Each fitting portion includes at least one first fitting convex portion, at least one first fitting concave portion to engage with the first fitting convex portion, at least one second fitting convex portion and a second fitting concave portion to engage with the second fitting convex portion.

5 Claims, 24 Drawing Sheets

(56) References Cited

U.S. PATENT DOCUMENTS

2010/0135712 A1* 6/2010 Igata ..... B42F 13/22
402/36

FOREIGN PATENT DOCUMENTS

| | | | |
|---|---|---|---|
| JP | 2000-289376 | A | 10/2000 |
| JP | 2002-502728 | A | 1/2002 |
| JP | 5023588 | B2 | 9/2012 |

* cited by examiner

BINDING COMPONENT

CROSS-REFERENCE TO RELATED APPLICATION

This application is based on and claims priority under 35 USC 119 from Japanese Patent Application No. 2014-087252 filed on Apr. 21, 2014.

TECHNICAL FIELD

The present invention relates to a binding component that binds a plurality of sheets of paper drilled with holes to make a booklet.

BACKGROUND

Conventionally, there is a binding component that is referred to as a binder for binding commercially available loose-leaf papers or papers punched by a punch.

Such a binding component has a configuration in which a plurality of annular ring parts is connected by a back part. Each of the ring parts divided into multiple pieces is connected by a flexible hinge portion so that the ring part can be opened and closed.

For example, JP-A-2000-289376 discloses a configuration in which a two-split ring part is connected by a flexible hinge portion. Further, JP-B-5023588 discloses a configuration in which a three-split ring part is connected by a flexible hinge portion, for example.

Furthermore, JP-A-2002-502728 discloses a configuration in which a lock mechanism is provided in a hinge portion, for example.

SUMMARY

In the configuration in which the split ring part is connected by the flexible hinge portion, a load is applied to the hinge portion when a booklet bound by a binding component is dropped, for example, and a load is thus applied to the ring part. As a result, there is a possibility that the hinge portion is damaged and the ring part is thus separated.

By providing a lock mechanism in the hinge portion, it is possible to receive a load from a certain direction. However, it is difficult to correspond to a load from any direction.

The present invention is made to improve the above-described issues and an object thereof is to provide a binding component that is capable of preventing the damage of the hinge portion.

A binding component of the present invention includes ring back portions, first ring arm portions, second ring arm portions and a back part. Each ring back portion is configured to be an annular ring part. Each first ring arm portion is configured to be the annular ring part and connects to one end of the ring back portion by a hinge portion. Each second ring arm portion is configured to be the annular ring part and connects to the other end of the ring back portion by a hinge portion. The ring back portions are connected to the back part at predetermined intervals. Each ring part includes fitting portions (i) at a place where the first ring arm portion and the ring back portion are connected to each other and (ii) at a place where the second ring arm portion and the ring back portion are connected to each other. The fitting portions are configured to be fitted by an operation of opening and closing the first ring arm portion and the second ring arm portion with (i) the hinge portion of the one end of the ring back portion as a support point and (ii) the hinge portion of the other end of the ring back portion as a support point. Each fitting portion includes at least one first fitting convex portion, at least one first fitting concave portion, at least one second fitting convex portion and a second fitting concave portion. The at least one first fitting convex portion is at an end of the first ring arm portion or at an end of the second ring arm portion. The said end is opposite to the ring back portion. The at least one first fitting concave portion is at the one end of the ring back portion opposite to the first ring arm portion or at the other end of the ring back portion opposite the second ring arm portion. The first fitting convex portion is configured to be fitted into the first fitting concave portion. The at least one second fitting convex portion is at the one end of the ring back portion opposite to the first ring arm portion or at the other end of the ring back portion opposite the second ring arm portion. The second fitting concave portion is at the end of the first ring arm portion or the end of the second ring arm portion. The second fitting convex portion is configured to be fitted into the second fitting concave portion. The first fitting convex portion includes a first convex-side load receiving surface at an outwardly facing surface opposite to the first fitting concave portion. The first fitting concave portion includes a first concave-side load receiving surface at an inwardly facing surface opposite to the first convex-side load receiving surface. The second fitting convex portion includes a second convex-side load receiving surface at an outwardly facing surface opposite to the second fitting concave portion. The second fitting concave portion includes a second concave-side load receiving surface at an inwardly facing surface opposite to the second convex-side load receiving surface. The first fitting convex portion includes a third convex-side load receiving surface at a width direction surface opposite to the first fitting concave portion. The first fitting concave portion includes a third concave-side load receiving surface at a width direction surface opposite to the third convex-side load receiving surface.

In the binding component of the present invention, when the first fitting convex portion is fitted into the first fitting concave portion by an operation of closing the first ring arm portion and the second ring arm portion, the first convex-side load receiving surface of the first fitting convex portion comes into contact with the first concave-side load receiving surface of the first fitting concave portion. Further, the third convex-side load receiving surface of the first fitting convex portion comes into contact with the third concave-side load receiving surface of the first fitting concave portion.

Further, when the second fitting convex portion is fitted into the second fitting concave portion, the second convex-side load receiving surface of the second fitting convex portion comes into contact with the second concave-side load receiving surface of the second fitting concave portion.

As a result, in the operation of closing the first ring arm portion and the second ring arm portion, the first fitting convex portion and the first fitting concave portion, and the second fitting convex portion and the second fitting concave portion serve as a guide in a width direction and a thickness direction.

Further, when a load of the impact such as dropping is applied, from any direction, to places where the first ring arm portion and the ring back portion are connected to each other and where the second ring arm portion and the ring back portion are connected to each other, this load is received by a combination of any one of the convex-side load receiving surfaces and the concave-side load receiving surfaces, so that the load applied to the hinge portion is reduced.

According to the binding component of the present invention, the concavo-convex shapes of the fitting portion are started to fit each other by the closing operation of the first ring arm portion and the second ring arm portion, so that the closing operation of the first ring arm portion and the second ring arm portion is guided. The first ring arm portion and the second ring arm portion can be closed at an accurate position.

When the first ring arm portion and the second ring arm portion are closed and thus the ring part becomes an annular shape, the concavo-convex shapes of the fitting portion are fitted each other to receive a load when a force is applied from the outside, for example. Accordingly, it is possible to suppress the damage of the hinge portion or the like.

DETAILED DESCRIPTION

Hereinafter, an illustrative embodiment of a binding component of the present invention will be described with reference to the drawings.

<Configuration Example of Binding Component of Present Embodiment>

Figure 1:
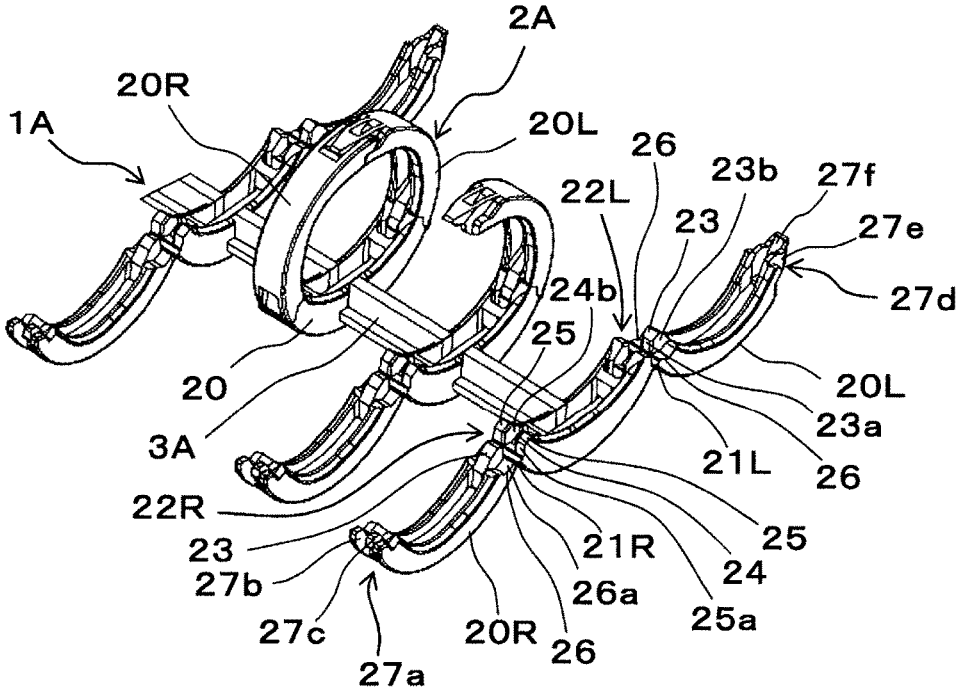
FIG. 1 is a perspective view showing an example of a binding component of the present embodiment.
Figure 2:
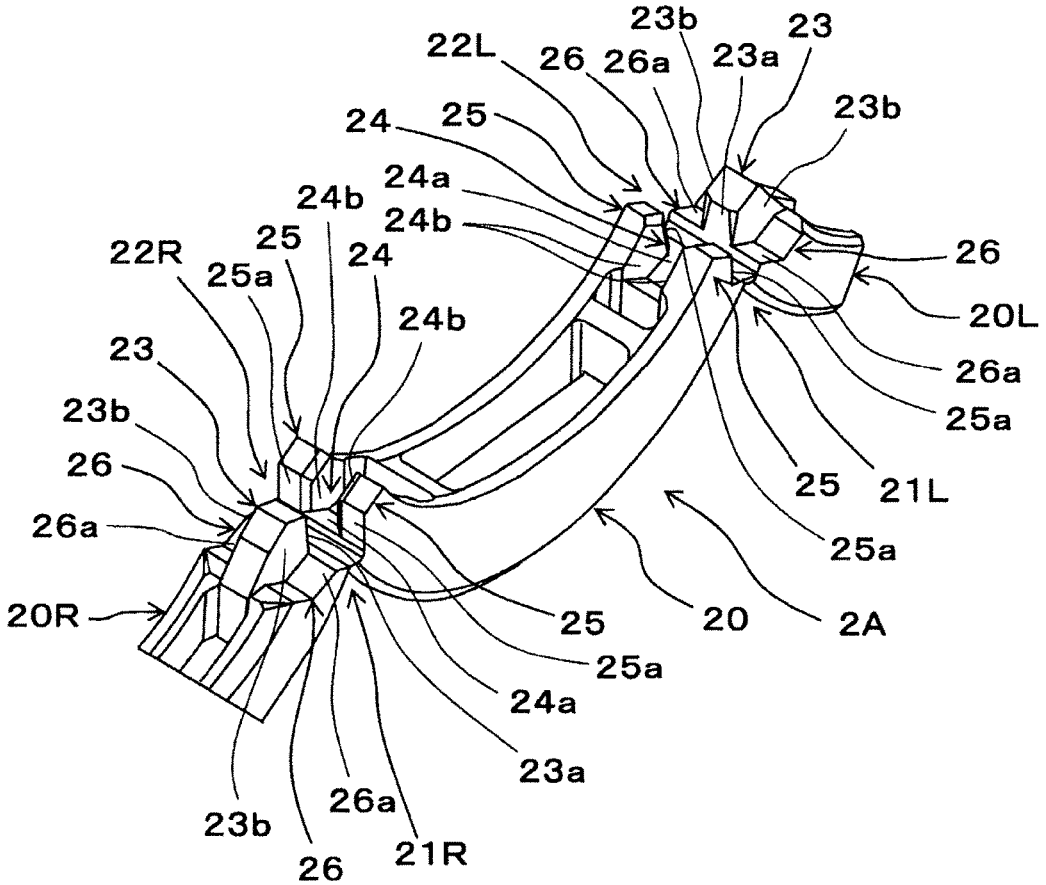
FIG. 2 is a perspective view showing a main configuration of the binding component of the present embodiment.

FIG. 1 is a perspective view showing an example of a binding component of the present embodiment and FIG. 2 is a perspective view showing a main configuration of the binding component of the present embodiment. A binding component 1A of a first embodiment includes a plurality of annular ring parts 2A and a back part 3A for connecting the plurality of ring parts 2A.

Each of the ring parts 2A includes a ring back portion 20 connected by the back part 3A, a first ring arm portion 20R connected to one end of the ring back portion 20 and a second ring arm portion 20L connected to the other end of the ring back portion 20. Each of the ring parts 2A is configured as an annular shape by a combination of three members of the ring back portion 20, the first ring arm portion 20R and the second ring arm portion 20L.

The ring parts 2A are stored in a paper processing device (to be described later) in a state where the first ring arm portion 20R and the second ring arm portion 20L are opened. The first ring arm portion 20R and the second ring arm portion 20L are closed by a binding operation in the paper processing device, so that a booklet is bound. Further, the first ring arm portion 20R and the second ring arm portion 20L are manually opened and closed, so that papers are added and removed.

Figure 3:
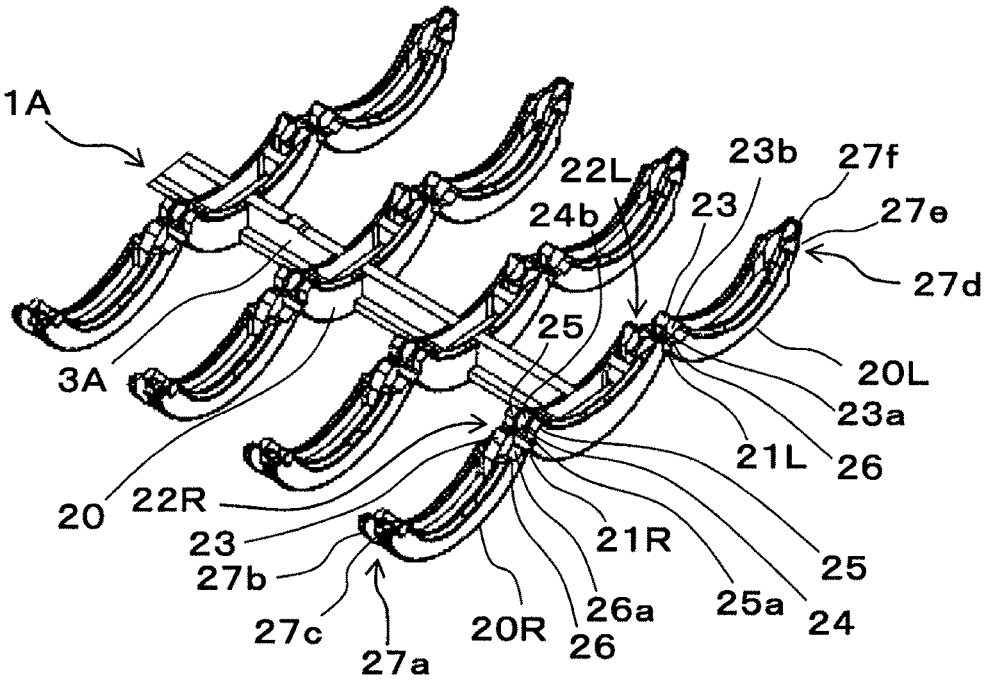
FIG. 3 is a perspective view showing an example of the binding component of the present embodiment.
Figure 4:
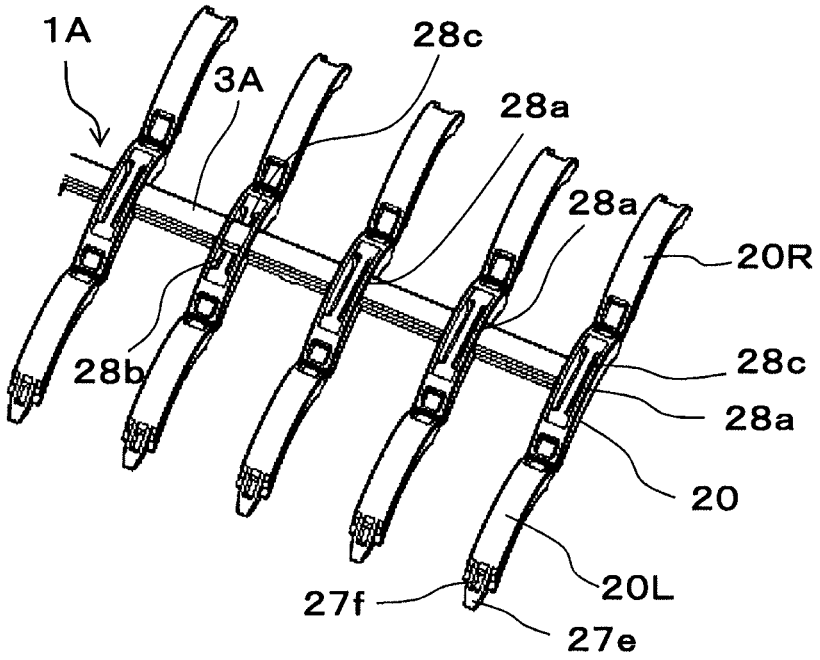
FIG. 4 is a perspective view showing an example of the binding component of the present embodiment.
Figure 5:
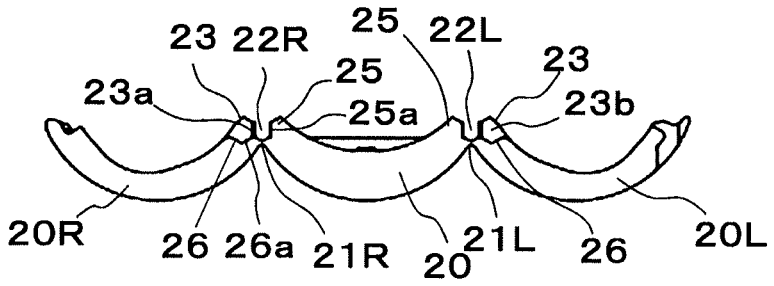
FIG. 5 is a front view showing an example of the binding component of the present embodiment.
Figure 6:
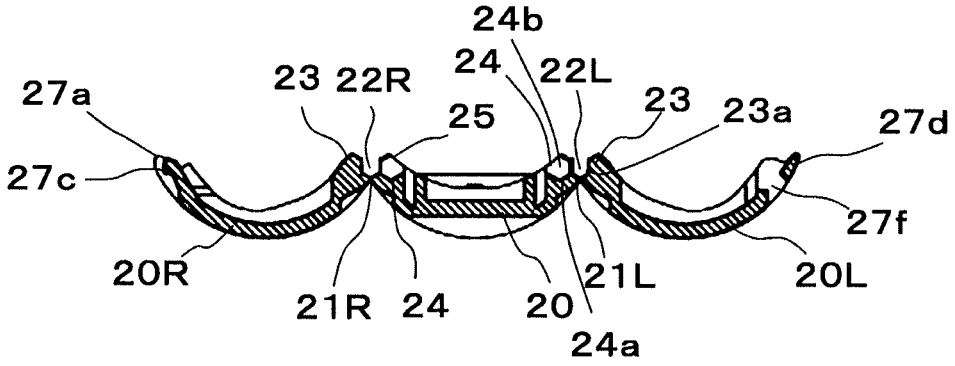
FIG. 6 is a front cross-sectional view showing an example of the binding component of the present embodiment.
Figure 7:
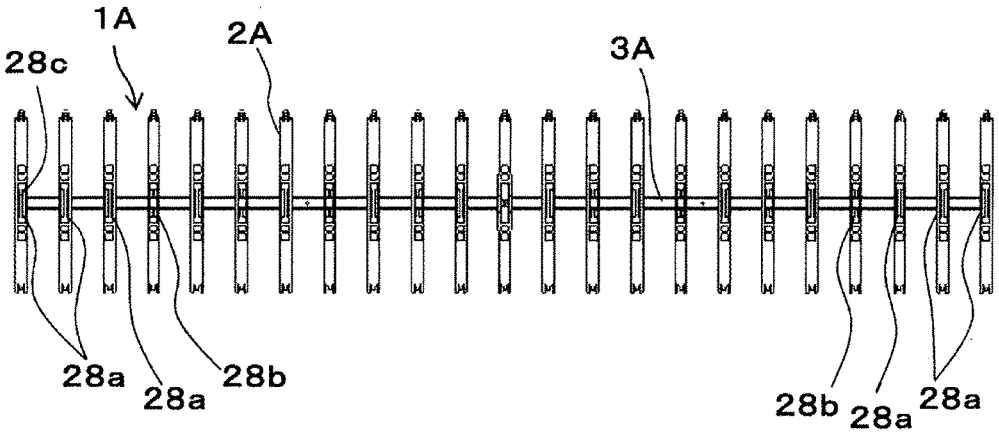
FIG. 7 is a plan view showing an example of the binding component of the present embodiment.

FIG. 3 and FIG. 4 are perspective views showing an example of the binding component of the present embodiment, FIG. 5 is a front view showing an example of the binding component of the present embodiment, FIG. 6 is a front cross-sectional view showing an example of the binding component of the present embodiment, and FIG. 7 is a plan view showing an example of the binding component of the present embodiment. Hereinafter, the ring part 2A is described in detail with reference to each of these drawings.

The ring back portion 20 has an arc shape that configures a portion of the annular ring part 2A. The first ring arm portion 20R has an arc shape that configures a portion of the annular ring part 2A. The first ring arm portion 20R is connected to one end of the arc of the ring back portion 20 in a circumferential direction by a hinge portion 21R. The second ring arm portion 20L has an arc shape that configures a portion of the annular ring part 2A. The second ring arm portion 20L is connected to the other end of the arc of the ring back portion 20 in the circumferential direction by a hinge portion 21L.

The hinge portion 21R is a place where the first ring arm portion 20R and the ring back portion 20 are connected to each other. The hinge portion 21R is configured by integrally molding a thin-shape portion on an outer peripheral side of the arc of the first ring arm portion 20R and the ring back portion 20. The thin-shape portion has a deformable thickness.

The first ring arm portion 20R is rotatably connected to the ring back portion 20 by the deformable hinge portion 21R, and the hinge portion 21R serves as a support point. In this way, the first ring arm portion 20R of the ring part 2A is opened and closed by a rotation operation using the hinge portion 21R as a support point.

The hinge portion 21L has the same configuration as the hinge portion 21R. The hinge portion 21L is a place where the second ring arm portion 20L and the ring back portion 20 are connected to each other. The hinge portion 21L is configured by integrally molding a thin-shape portion on an outer peripheral side of the arc of the second ring arm portion 20L and the ring back portion 20. The thin-shape portion has a deformable thickness.

The second ring arm portion 20L is rotatably connected to the ring back portion 20 by the deformable hinge portion 21L, and the hinge portion 21L serves as a support point. In this way, the second ring arm portion 20L of the ring part 2A is opened and closed by a rotation operation using the hinge portion 21L as a support point.

The ring part 2A includes a fitting portion 22R on an inner peripheral side of the arc of the first ring arm portion 20R and the ring back portion 20. The fitting portion 22R is a place where the first ring arm portion 20R and the ring back portion 20 are connected to each other. Further, the ring part 2A includes a fitting portion 22L on an inner peripheral side of the arc of the second ring arm portion 20L and the ring back portion 20. The fitting portion 22L is a place where the second ring arm portion 20L and the ring back portion 20 are connected to each other.

The fitting portion 22R has a concavo-convex shape that is engageable and fitted by a rotation operation of the first ring arm portion 20R, which uses the hinge portion 21R as a support point. Similarly, the fitting portion 22L has a concavo-convex shape that is engageable and fitted by a rotation operation of the second ring arm portion 20L, which uses the hinge portion 21L as a support point.

In the ring part 2A, the fitting by the concavo-convex shape of the fitting portion 22R and the fitting by the concavo-convex shape of the fitting portion 22L are started by a closing operation of the first ring arm portion 20R and the second ring arm portion 20L. In this way, the opening and closing operation of the first ring arm portion 20R and the second ring arm portion 20L is guided.

Further, the ring part 2A forms an annular shape when the first ring arm portion 20R and the second ring arm portion 20L are closed. In this case, the concavo-convex shape of the fitting portion 22R is fitted and the concavo-convex shape of the fitting portion 22L is fitted to receive a load when a force is applied from the outside, for example. As a result, the damage of the hinge portion 21R and the hinge portion 21L or the like is suppressed.

Subsequently, the fitting portion 22R and the fitting portion 22L, which are capable of receiving a load, are described in detail. Here, in the ring back portion 20, the first ring arm portion 20R and the second ring arm portion 20L, a radial direction of the arc of the annular ring part 2A is referred to as a thickness and an extension direction of a center axis of the arc of the annular ring part 2A is referred to as a width.

The fitting portion 22R includes a first fitting convex portion 23 at an end of the first ring arm portion 20R opposite to the ring back portion 20 that is connected to the first ring arm portion 20R by the hinge portion 21R. Further, the fitting portion 22R includes a first fitting concave portion 24 at an end of the ring back portion 20 opposite to the first ring arm portion 20R that is connected to the ring back portion 20 by the hinge portion 21R. The first fitting convex portion 23 is fitted into the first fitting concave portion 24.

Additionally, the fitting portion 22R includes second fitting convex portions 25 at an end of the ring back portion 20 opposite to the first ring arm portion 20R. Further, the fitting portion 22R includes second fitting concave portions 26 at an end of the first ring arm portion 20R opposite to the ring back portion 20. The second fitting convex portions 25 are fitted into the second fitting concave portions 26.

The first fitting convex portion 23 is configured by a convex portion at the center of the first ring arm portion 20R in a width direction. The convex portion is projected toward the ring back portion 20. The first fitting concave portion 24 is configured by a concave portion at the center of the ring back portion 20 in a width direction. An inner peripheral surface of the concave portion and an end of the concave portion opposite to the first ring arm portion 20R are open. The concave portion has a shape into which the first fitting convex portion 23 is fitted.

The second fitting convex portions 25 are configured by convex portions at both sides of the first fitting concave portion 24 in the width direction of the ring back portion 20. The convex portions are projected toward the first ring arm portion 20R. The second fitting concave portions 26 are configured by concave portions at both sides of the first fitting convex portion 23 in the width direction of the first ring arm portion 20R. An inner peripheral surface of the concave portions and an end of the concave portions opposite to the ring back portion 20 are open. The concave portions have a shape into which the second fitting convex portions 25 are fitted.

The first fitting convex portion 23 includes a first convex-side load receiving surface 23*a*. The first convex-side load receiving surface 23*a* is formed at an outwardly facing surface of the annular ring part 2A opposite to the first fitting concave portion 24. The first fitting concave portion 24 includes a first concave-side load receiving surface 24*a*. The first concave-side load receiving surface 24*a* is formed at an inwardly facing surface of the annular ring part 2A opposite to the first convex-side load receiving surface 23*a* of the first fitting convex portion 23.

The second fitting convex portion 25 includes a second convex-side load receiving surface 25*a*. The second convex-side load receiving surface 25*a* is formed at an outwardly facing surface of the annular ring part 2A opposite to the second fitting concave portion 26. The second fitting concave portion 26 includes a second concave-side load receiving surface 26*a*. The second concave-side load receiving surface 26*a* is formed at an inwardly facing surface of the annular ring part 2A opposite to the second convex-side load receiving surface 25*a* of the second fitting convex portion 25.

The first fitting convex portion 23 includes a third convex-side load receiving surface 23*b*. The third convex-side load receiving surface 23*b* is formed at both sides in the width direction of the annular ring part 2A and is opposite to the first fitting concave portion 24. The first fitting concave portion 24 includes a third concave-side load receiving surface 24*b*. The third concave-side load receiving surface 24*b* is formed at an inwardly facing surface in the width direction of the annular ring part 2A and is opposite to the third convex-side load receiving surface 23*b* of the first fitting convex portion 23.

In the present example, the first fitting concave portion 24 is formed adjacent to and on the inner side of the second fitting convex portion 25. Accordingly, the third concave-side load receiving surface 24*b* is configured as a surface facing the inner side of the first fitting concave portion 24 and facing the inner side of the second fitting convex portion 25.

When the first ring arm portion 20R and the second ring arm portion 20L are closed and the annular ring part 2A is thus formed, the first fitting convex portion 23 in the fitting portion 22R is fitted into the first fitting concave portion 24 at a place where the first ring arm portion 20R and the ring back portion 20 are connected to each other. Further, the second fitting convex portion 25 is fitted into the second fitting concave portion 26.

When the first fitting convex portion 23 is fitted into the first fitting concave portion 24, the first convex-side load receiving surface 23*a* of the first fitting convex portion 23 comes into contact with the first concave-side load receiving surface 24*a* of the first fitting concave portion 24. Further, the third convex-side load receiving surface 23*b* of the first fitting convex portion 23 comes into contact with the third concave-side load receiving surface 24*b* of the first fitting concave portion 24.

Additionally, when the second fitting convex portion 25 is fitted into the second fitting concave portion 26, the second convex-side load receiving surface 25*a* of the second fitting convex portion 25 comes into contact with the second concave-side load receiving surface 26*a* of the second fitting concave portion 26.

In this way, the first fitting convex portion 23 and the first fitting concave portion 24 are fitted in a concavo-convex shape that is formed in a thickness direction of the first ring arm portion 20R and the ring back portion 20. Further, the second fitting convex portion 25 and the second fitting concave portion 26 are fitted in a concavo-convex shape that is formed in the thickness direction of the first ring arm portion 20R and the ring back portion 20. In addition, the first fitting convex portion 23 and the first fitting concave portion 24, and the second fitting convex portion 25 and the second fitting concave portion 26 are fitted in a concavo-convex shape that is formed in a width direction of the first ring arm portion 20R and the ring back portion 20.

The fitting portion 22R is configured in such a way that, in the opening and closing operation using the hinge portion 21R as a support point, the pathway of the first fitting convex portion 23 does not overlap with the first fitting concave portion 24 and the pathway of the second fitting convex portion 25 does not overlap with the second fitting concave portion 26. Accordingly, in the operation of opening and closing the first ring arm portion 20R with the hinge portion 21R as a support point, the fitting portion 22R is configured so as to be engageable without being locked and without interference.

The fitting portion 22L has the same configuration as the fitting portion 22R. The fitting portion 22L includes the first fitting convex portion 23 and the second fitting concave portion 26 at an end of the second ring arm portion 20L opposite to the ring back portion 20 that is connected to the second ring arm portion 20L by the hinge portion 21L.

Further, the fitting portion 22L includes the first fitting concave portion 24 and the second fitting convex portion 25 at an end of the ring back portion 20 opposite to the second ring arm portion 20L that is connected to the ring back portion 20 by the hinge portion 21L. The first fitting convex portion 23 is fitted into the first fitting concave portion 24 and the second fitting convex portion 25 is fitted into the second fitting concave portion 26.

The first fitting convex portion 23, the first fitting concave portion 24, the second fitting convex portion 25 and the second fitting concave portion 26 of the fitting portion 22L have the same configuration as those of the fitting portion 22R. The first convex-side load receiving surface 23*a* and the first concave-side load receiving surface 24*a*, and the third convex-side load receiving surface 23*b* and the third concave-side load receiving surface 24*b* are formed at opposite surfaces of the first fitting convex portion 23 and the first fitting concave portion 24. Further, the second convex-side load receiving surface 25*a* and the second concave-side load receiving surface 26*a* are formed at opposite surfaces of the second fitting convex portion 25 and the second fitting concave portion 26.

When the first ring arm portion 20R and the second ring arm portion 20L are closed and the annular ring part 2A is thus formed, the first fitting convex portion 23 of the fitting portion 22L is fitted into the first fitting concave portion 24 at a place where the second ring arm portion 20L and the ring back portion 20 are connected to each other. Further, the second fitting convex portion 25 is fitted into the second fitting concave portion 26.

When the first fitting convex portion 23 is fitted into the first fitting concave portion 24, the first convex-side load receiving surface 23*a* of the first fitting convex portion 23 comes into contact with the first concave-side load receiving surface 24*a* of the first fitting concave portion 24. Further, the third convex-side load receiving surface 23*b* of the first fitting convex portion 23 comes into contact with the third concave-side load receiving surface 24*b* of the first fitting concave portion 24.

Additionally, when the second fitting convex portion 25 is fitted into the second fitting concave portion 26, the second convex-side load receiving surface 25*a* of the second fitting convex portion 25 comes into contact with the second concave-side load receiving surface 26*a* of the second fitting concave portion 26.

In this way, the first fitting convex portion 23 and the first fitting concave portion 24 are fitted in a concavo-convex shape that is formed in a thickness direction of the second ring arm portion 20L and the ring back portion 20. Further, the second fitting convex portion 25 and the second fitting concave portion 26 are fitted in a concavo-convex shape that is formed in the thickness direction of the second ring arm portion 20L and the ring back portion 20. In addition, the first fitting convex portion 23 and the first fitting concave portion 24, and the second fitting convex portion 25 and the second fitting concave portion 26 are fitted in a concavo-convex shape that is formed in a width direction of the second ring arm portion 20L and the ring back portion 20.

The fitting portion 22L is also configured in such a way that, in the opening and closing operation using the hinge portion 21L as a support point, the pathway of the first fitting convex portion 23 does not overlap with the first fitting concave portion 24 and the pathway of the second fitting convex portion 25 does not overlap with the second fitting concave portion 26. Accordingly, in the operation of opening and closing the second ring arm portion 20L with the hinge portion 21L as a support point, the fitting portion 22L is configured so as to be engageable without being locked and without interference.

Subsequently, a configuration which locks the first ring arm portion 20R and the second ring arm portion 20L will be described in order to maintain the annular form after the first ring arm portion 20R and the second ring arm portion 20L are closed and the annular ring part 2A is thus formed.

The ring part 2A includes a first locking portion 27*a* at a leading end in a circumferential direction of the arc of the first ring arm portion 20R. The first locking portion 27*a* includes a locking claw 27*c* in a concave guide portion 27*b*.

The concave guide portion 27*b* is configured by a concave portion at an outer peripheral side of the first ring arm portion 20R. The concave portion is open at the leading end side and both sides in the width direction of the first ring arm portion 20R. The locking claw 27*c* is formed on the inner side of the concave guide portion 27*b*. The locking claw 27 has a hook shape whose leading end has a triangular shape and is projected outward.

The ring part 2A includes a second locking portion 27*d* at a leading end in a circumferential direction of the arc of the second ring arm portion 20L. The second locking portion 27*d* includes a claw receiving portion 27*f* in a convex guide portion 27*e*.

The convex guide portion 27*e* is configured by a convex portion at the leading end of the second ring arm portion 20L. The convex portion has a shape that is fitted into the portion of the annular ring part 2A located between the concave guide portions 27*b* of the first locking portion 27*a*. The claw receiving portion 27*f* is configured by a hole portion at the convex guide portion 27*e*. The locking claw 27*c* of the first locking portion 27*a* is fitted and locked into the hole portion when the convex guide portion 27*e* is fitted between the concave guide portions 27*b* of the first locking portion 27*a*.

Subsequently, the back part 3A for connecting the ring parts 2A and the ring back portions 20 of the ring parts 2A connected by the back part 3A will be described in detail. The back part 3A extends linearly. At predetermined intervals, the ring back portions 20 of the ring parts 2A are provided integrally with the back part 3A.

Each of the ring back portion 20 is provided with a first slit 28*a* and a second slit 28*b*. The first slit 28*a* is configured by an opening along a circumferential direction of the arc of the ring back portion 20. The opening penetrates an inner peripheral side and an outer peripheral side of the ring back portion 20. The first slit 28*a* is open at the position where the back part 3A is provided.

The second slit 28*b* is not open at the position where the back part 3A is provided. The second slit 28*b* is configured by an opening at both sides of the back part 3A along the circumferential direction of the arc of the ring back portion 20. The opening penetrates the inner peripheral side and the outer peripheral side of the ring back portion 20.

The first slit 28*a* and the second slit 28*b* are provided with bridges 28*c* extending along the circumferential direction of the arc of the ring back portion 20. A part of the opening is connected by the bridges 28*c*.

In the binding component 1A, the first slits 28*a* are respectively provided at the ring parts 2A on both end sides along the extension direction of the back part 3A. Preferably, the first slit 28*a* is provided, at least, at one ring part 2A on each of both end sides along the extension direction of the back part 3A. More preferably, the first slits 28*a* are provided at two or more ring parts 2A on each of both end sides along the extension direction of the back part 3A. Further, it is preferable that the first slit 28*a* is provided also on the central side in the extension direction of the back part 3A.

The second slit 28*b* is respectively provided at the ring parts 2A other than the ring parts 2A where the first slit 28*a* is provided.

As a result, in the binding component 1A, the portion where the first slit 28*a* is provided is deformed when a load is applied by the impact such as dropping, so that the impact is absorbed. Further, by providing the second slit 28*b*, rigidity for preventing the deformation of the back part 3A in a binding operation of a binding device (to be described later) is secured.

<Usage Example of Binding Component of Present Embodiment>

Figure 8:
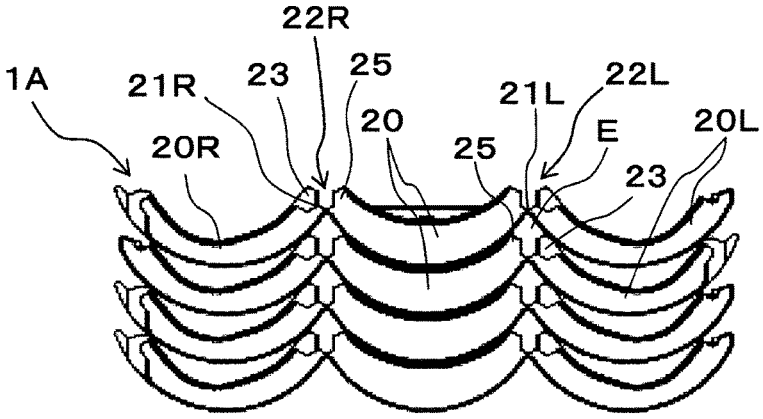
FIG. 8 is a front view showing a usage example of the binding component of the present embodiment.

FIG. 8 is a front view showing a usage example of the binding component of the present embodiment. FIG. 8 shows a situation where the binding components 1A are stored.

A plurality of binding components 1A are stacked in a state where the first ring arm portions 20R and the second ring arm portions 20L are open. In the state where the first ring arm portions 20R and the second ring arm portions 20L are open, the first fitting convex portions 23 of the fitting portion 22R and the fitting portion 22L protrude upward from the end of the first ring arm portion 20R and the end of the second ring arm portion 20L and the second fitting convex portions 25 thereof protrude upward from both ends of the ring back portion 20.

The first fitting convex portion 23 and the second fitting convex portion 25 have a shape and a size so that these convex portions are fitted into a clearance E. The clearance E is formed between the adjacent binding components 1A stacked in a stack direction vertically in a state where the first ring arm portions 20R and the second ring arm portions 20L are open and a plurality of binding components 1A are stacked in the stack direction.

As a result, in the state where the binding components 1A are stacked and stored, the height in the stack direction is suppressed, so that it is possible to reduce the space required for storage.

Figure 9:
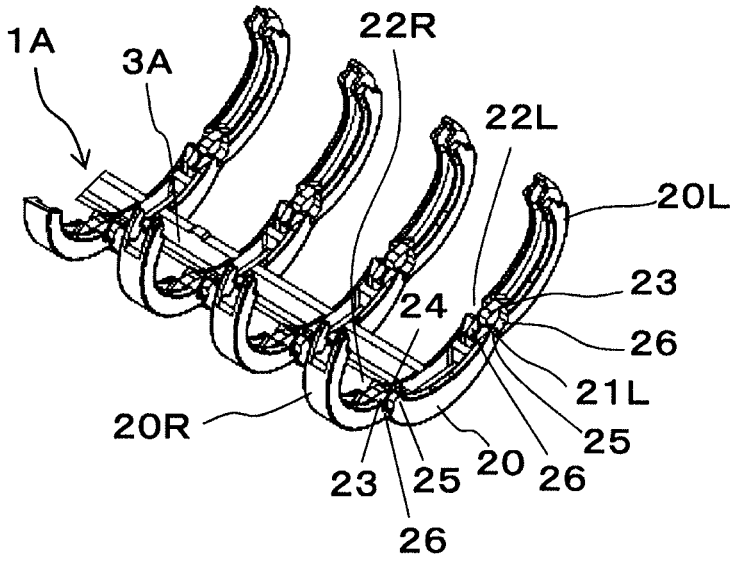
FIG. 9 is a perspective view showing a usage example of the binding component of the present embodiment.
Figure 10:
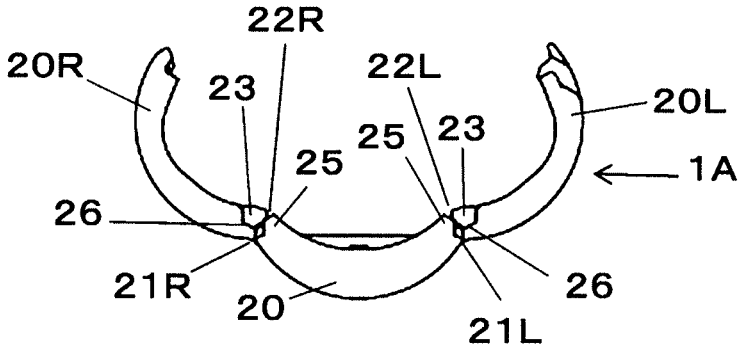
FIG. 10 is a front view showing a usage example of the binding component of the present embodiment.
Figure 11:
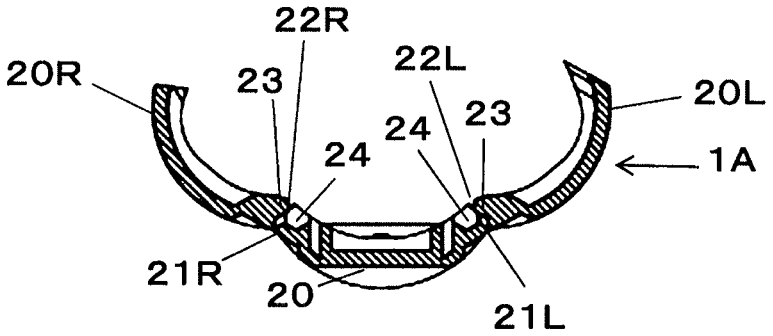
FIG. 11 is a front cross-sectional view showing a usage example of the binding component of the present embodiment.

FIG. 9 is a perspective view showing a usage example of the binding component of the present embodiment, FIG. 10 is a front view showing a usage example of the binding component of the present embodiment, and FIG. 11 is a front cross-sectional view showing a usage example of the binding component of the present embodiment. FIG. 9 to FIG. 11 show an intermediate situation in the course of closing the first ring arm portions 20R and the second ring arm portions 20L.

Figure 12:
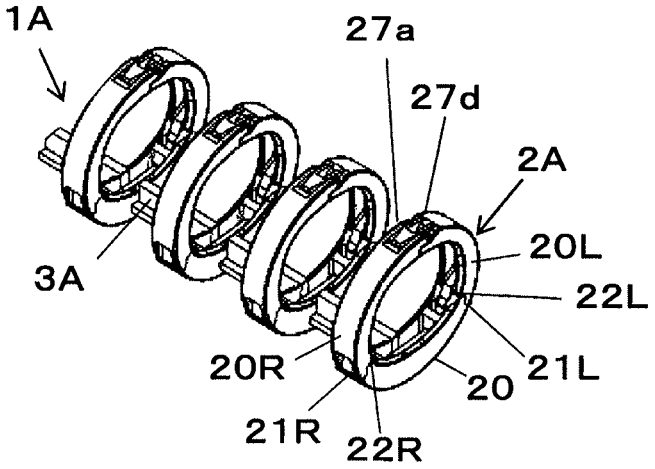
FIG. 12 is a perspective view showing a usage example of the binding component of the present embodiment.
Figure 13:
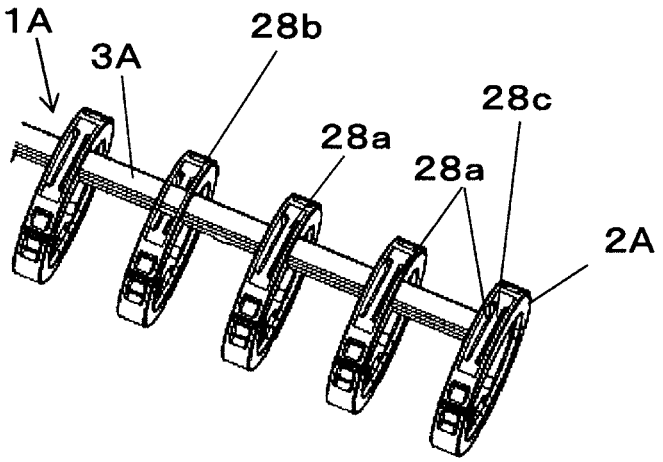
FIG. 13 is a perspective view showing a usage example of the binding component of the present embodiment.
Figure 14:
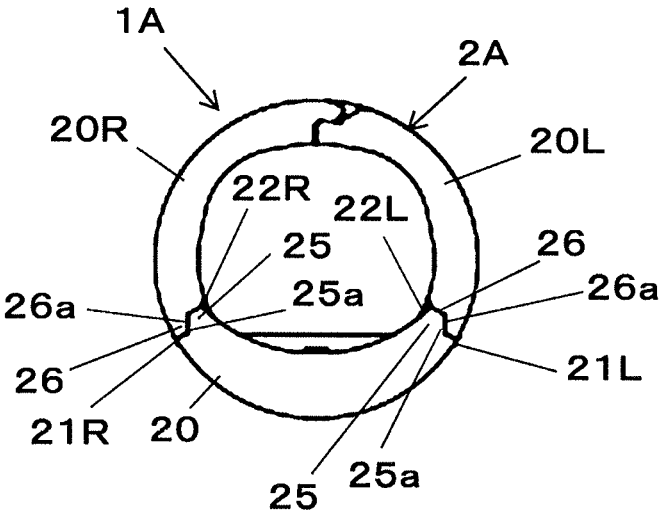
FIG. 14 is a front view showing a usage example of the binding component of the present embodiment.
Figure 15:
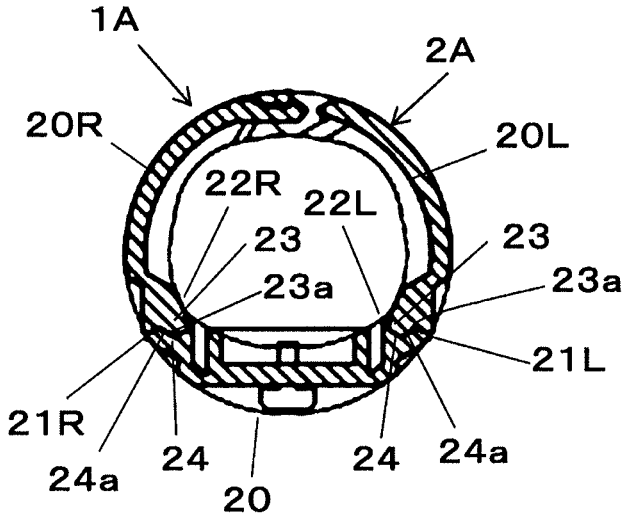
FIG. 15 is a front cross-sectional view showing a usage example of the binding component of the present embodiment.

Further, FIG. 12 and FIG. 13 are perspective views showing a usage example of the binding component of the present embodiment, FIG. 14 is a front view showing a usage example of the binding component of the present embodiment, and FIG. 15 is a front cross-sectional view showing a usage example of the binding component of the present embodiment. FIG. 12 to FIG. 15 show a situation where the first ring arm portions 20R and the second ring arm portions 20L are closed.

Hereinafter, an operation of closing the first ring arm portions 20R and the second ring arm portions 20L is described. The first ring arm portions 20R and the second ring arm portions 20L are moved and displaced in a closing direction in a binding operation or the like of a paper processing device (to be described later).

As shown in FIG. 9 to FIG. 11, when the first ring arm portions 20R and the second ring arm portions 20L are moved and displaced in the closing direction, in the fitting portion 22, the first fitting convex portion 23 and the first fitting concave portion 24 are started to fit each other and the second fitting convex portion 25 and the second fitting concave portion 26 are started to fit each other. Further, similarly for the fitting portion 22L, the fitting of the first fitting convex portion 23 and the first fitting concave portion 24 is started and the fitting of the second fitting convex portion 25 and the second fitting concave portion 26 is started.

The first fitting convex portion 23 and the first fitting concave portion 24 are fitted in a concavo-convex shape that is formed in a thickness direction of the first ring arm portion 20R and the ring back portion 20. Further, the second fitting convex portion 25 and the second fitting concave portion 26 are fitted in a concavo-convex shape that is formed in the thickness direction of the first ring arm portion 20R and the ring back portion 20.

As a result, in the process of closing the first ring arm portion 20R, the first fitting convex portion 23 and the first fitting concave portion 24, and the second fitting convex portion 25 and the second fitting concave portion 26 serve as a guide in a thickness direction. Accordingly, the first ring arm portion 20R and the ring back portion 20 are prevented from being positional-deviated in the thickness direction.

Similarly for the second ring arm portion 20L, in the process of closing the second ring arm portion 20L, the first fitting convex portion 23 and the first fitting concave portion 24, and the second fitting convex portion 25 and the second fitting concave portion 26 serve as a guide in a thickness direction. Accordingly, the second ring arm portion 20L and the ring back portion 20 are prevented from being the positional-deviated in the thickness direction.

Further, the first fitting convex portion 23 and the first fitting concave portion 24 are fitted in a concavo-convex shape that is formed in a width direction in the first ring arm portion 20R and the ring back portion 20, and the second fitting convex portion 25 and the second fitting concave portion 26 are fitted in a concavo-convex shape that is formed in a width direction in the second ring arm portion 20L and the ring back portion 20.

As a result, in the process of closing the first ring arm portion 20R, the first fitting convex portion 23 and the first fitting concave portion 24, and the second fitting convex portion 25 and the second fitting concave portion 26 serve as a guide in a thickness direction. Accordingly, the first ring arm portion 20R is prevented from being positional-deviated in an axial direction of a rotation operation with the hinge portion 21R as a support point. Further, the first ring arm portion 20R is prevented from being positional-deviated in a twisted direction at the hinge portion 21R.

Similarly for the second arm portion 20L, in the process of closing the second ring arm portion 20L, the first fitting convex portion 23 and the first fitting concave portion 24, and the second fitting convex portion 25 and the second fitting concave portion 26 serve as a guide in a thickness direction. Accordingly, the second ring arm portion 20L is prevented from being positional-deviated in an axial direction of a rotation operation with the hinge portion 21L as a support point. Further, the second ring arm portion 20L is prevented from being positional-deviated in a twisted direction at the hinge portion 21L.

As shown in FIG. 12 to FIG. 15, when the first ring arm portions 20R and the second ring arm portions 20L are closed, the convex guide portion 27*e* of the second locking portion 27*d* is fitted into the concave guide portions 27*b* of the first locking portion 27*a*, and the locking claw 27*c* of the first locking portion 27*a* is fitted into the claw receiving portion 27*f* of the second locking portion 27*d*.

As described above, in the process of closing the first ring arm portion 20R and the second ring arm portion 20L, the positional deviation in the width direction and the thickness direction of the first ring arm portion 20R and the second ring arm portion 20L are suppressed by the first fitting convex portion 23 and the first fitting concave portion 24, and the second fitting convex portion 25 and the second fitting concave portion 26.

As a result, in the operation of locking the first locking portion 27*a* and the second locking portion 27*d*, the positional deviation between the first locking portion 27*a* and the second locking portion 27*d* is suppressed, and the locking claw 27*c* and the claw receiving portion 27*f* are securely locked.

When the first ring arm portion 20R and the second ring arm portion 20L are closed and the annular ring part 2A are thus formed, in the fitting portion 22R, the first fitting convex portion 23 is fitted into the first fitting concave portion 24 and the second fitting convex portion 25 is fitted into the second fitting concave portion 26.

When the first fitting convex portion 23 is fitted into the first fitting concave portion 24, the first convex-side load receiving surface 23*a* of the first fitting convex portion 23 comes into contact with the first concave-side load receiving surface 24*a* of the first fitting concave portion 24. Further, the third convex-side load receiving surface 23*b* of the first fitting convex portion 23 comes into contact with the third concave-side load receiving surface 24*b* of the first fitting concave portion 24.

Additionally, when the second fitting convex portion 25 is fitted into the second fitting concave portion 26, the second convex-side load receiving surface 25*a* of the second fitting convex portion 25 comes into contact with the second concave-side load receiving surface 26*a* of the second fitting concave portion 26.

As a result, when a load of the impact such as dropping is applied to a place where the first ring arm portion 20R and the ring back portion 20 are connected to each other, for example, a load of pressing the ring back portion 20 inwardly and a load of pressing the first ring arm portion 20R outwardly are received by the contact of the first convex-side load receiving surface 23*a* of the first fitting convex portion 23 and the first concave-side load receiving surface 24*a* of the first fitting concave portion 24.

Further, a load of pressing the ring back portion 20 outwardly and a load of pressing the first ring arm portion 20R inwardly are received by the contact of the second convex-side load receiving surface 25*a* of the second fitting convex portion 25 and the second concave-side load receiving surface 26*a* of the second fitting concave portion 26.

In addition, a load of pressing the first ring arm portion 20R or the ring back portion 20 in an axial direction of a rotation operation with the hinge portion 21R as a support point is received by the contact of the third convex-side load receiving surface 23*b* of the first fitting convex portion 23 and the third concave-side load receiving surface 24*b* of the first fitting concave portion 24.

Accordingly, when a load of the impact such as dropping is applied, from any direction, to a place where the first ring arm portion 20R and the ring back portion 20 are connected to each other, this load is received by a combination of any one of the convex-side load receiving surfaces and the concave-side load receiving surfaces, so that the load applied to the hinge portion 21R is reduced. Accordingly, the damage of the hinge portion 21R is prevented and therefore it is possible to prevent the first ring arm portion 20R from being separated from the ring back portion 20.

Similarly, in the second ring arm portion 20L, the same effect is obtained by the fitting portion 22L. For example, a load of pressing the ring back portion 20 inwardly and a load of pressing the second ring arm portion 20L outwardly are received by the contact of the first convex-side load receiving surface 23*a* of the first fitting convex portion 23 and the first concave-side load receiving surface 24*a* of the first fitting concave portion 24.

Further, a load of pressing the ring back portion 20 outwardly and a load of pressing the second ring arm portion 20L inwardly are received by the contact of the second convex-side load receiving surface 25*a* of the second fitting convex portion 25 and the second concave-side load receiving surface 26*a* of the second fitting concave portion 26.

In addition, a load of pressing the second ring arm portion 20L or the ring back portion 20 in an axial direction of a rotation operation with the hinge portion 21L as a support point is received by the contact of the third convex-side load receiving surface 23*b* of the first fitting convex portion 23 and the third concave-side load receiving surface 24*b* of the first fitting concave portion 24.

Accordingly, when a load of the impact such as dropping is applied, from any direction, to a place where the second ring arm portion 20L and the ring back portion 20 are connected to each other, this load is received by a combination of any one of the convex-side load receiving surfaces and the concave-side load receiving surfaces, so that the load applied to the hinge portion 21L is reduced. Accordingly, the damage of the hinge portion 21L is prevented and therefore it is possible to prevent the second ring arm portion 20L from being separated from the ring back portion 20.

Further, in the binding component 1A, the portion where the first slit 28*a* is provided is deformed when a load is applied by the impact such as dropping, so that the impact is absorbed. Particularly, by providing the first slits 28*a* to the ring parts 2A located at both ends in the extension direction of the back part 3A, the back part 3A is curvedly deformed when a booklet is falling from its corner, for example. In this way, it is possible to absorb the impact.

Figure 16:
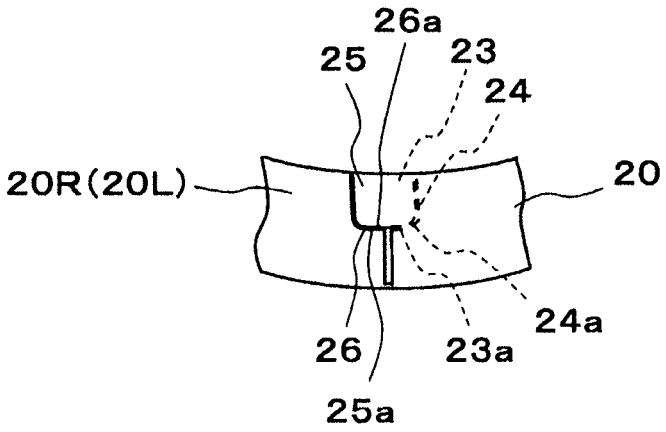
FIG. 16 is a front view of a main portion showing a usage example of the binding component of the present embodiment.
Figure 17:
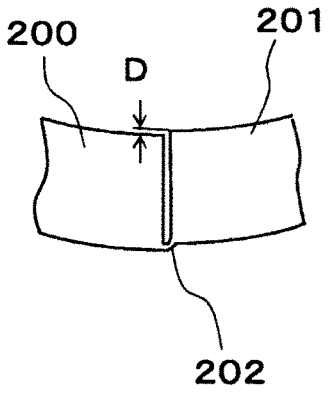
FIG. 17 is a front view of a main portion showing a usage example of a conventional binding component.

FIG. 16 is a front view of a main portion showing a usage example of the binding component of the present embodiment, and FIG. 17 is a front view of a main portion showing a usage example of a conventional binding component. In the conventional configuration without the fitting portion as in the present embodiment at a place where a ring arm portion and a ring back portion are connected to each other, a ring arm portion 200 and a ring back portion 201 are positional-deviated in a thickness direction due to deformation of a hinge portion 202 and thus a stepped portion D is often formed, as shown in FIG. 17. In this case, an opening edge of holes of the paper bound by the binding component often hits the stepped portion D. In such a case, there is a possibility that the bound paper cannot be smoothly turned over.

On the contrary, in the present embodiment, the first convex-side load receiving surface 23*a* of the first fitting convex portion 23 comes into contact with the first concave-side load receiving surface 24*a* of the first fitting concave portion 24, and the second convex-side load receiving surface 25*a* of the second fitting convex portion 25 comes into contact with the second concave-side load receiving surface 26*a* of the second fitting concave portion 26, as shown in FIG. 16. In this way, the first ring arm portion 20R and the second ring arm portion 20L are prevented from being positional-deviated in a thickness direction relative to the ring back portion 20.

<Modified Example of Binding Component of Present Embodiment>

Figure 18:
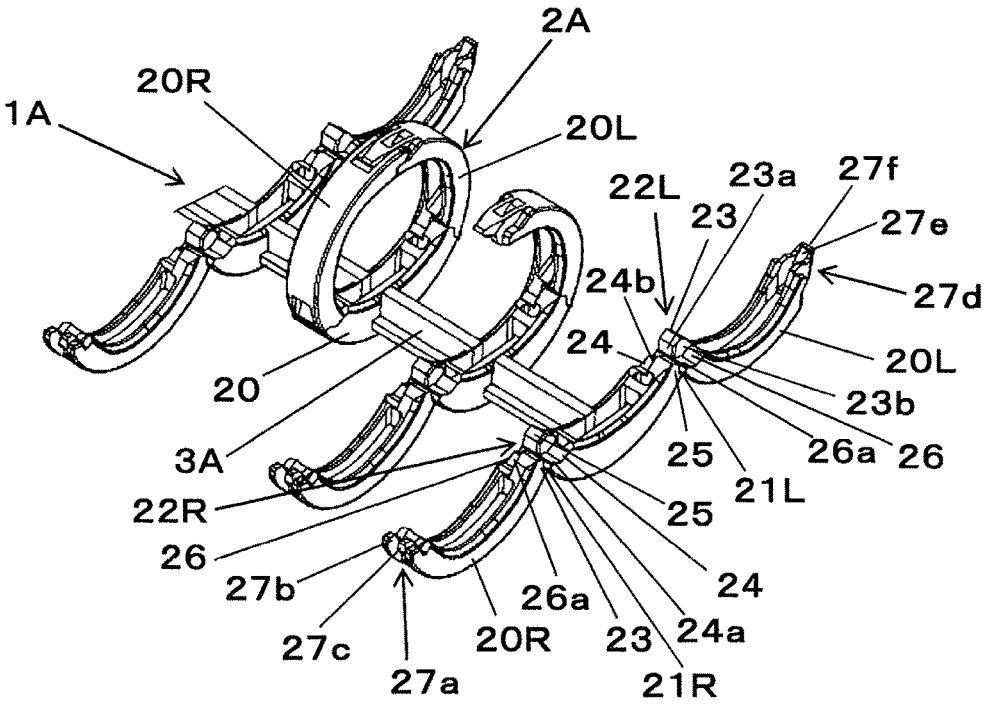
FIG. 18 is a perspective view showing a modified example of the binding component of the present embodiment.
Figure 19:
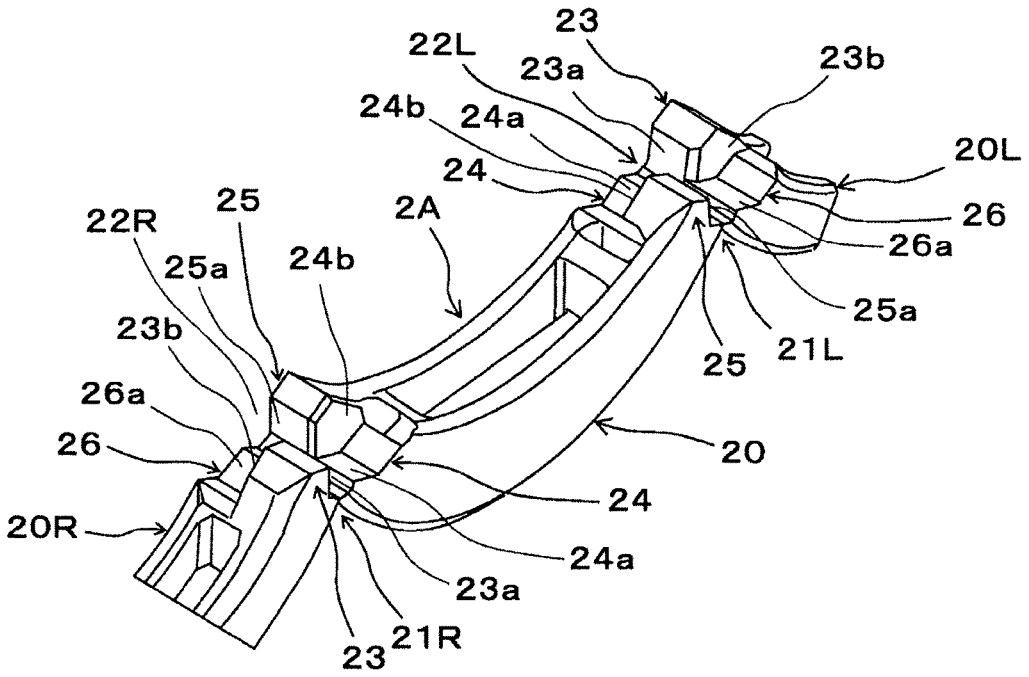
FIG. 19 is a perspective view showing a main configuration of the binding component of the modified example.
Figure 20:
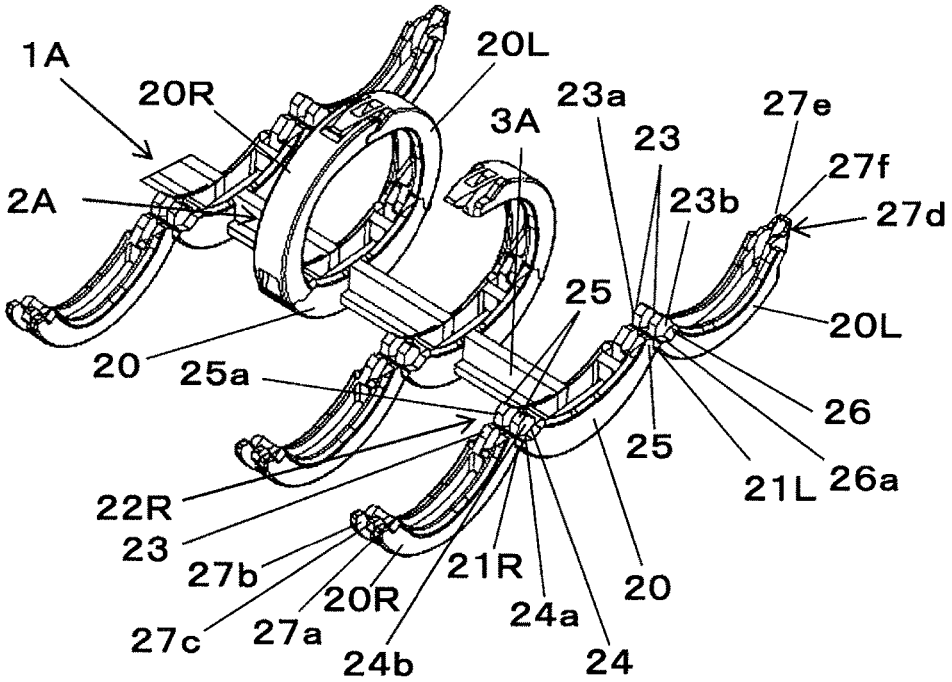
FIG. 20 is a perspective view showing another modified example of the binding component of the present embodiment.
Figure 21:
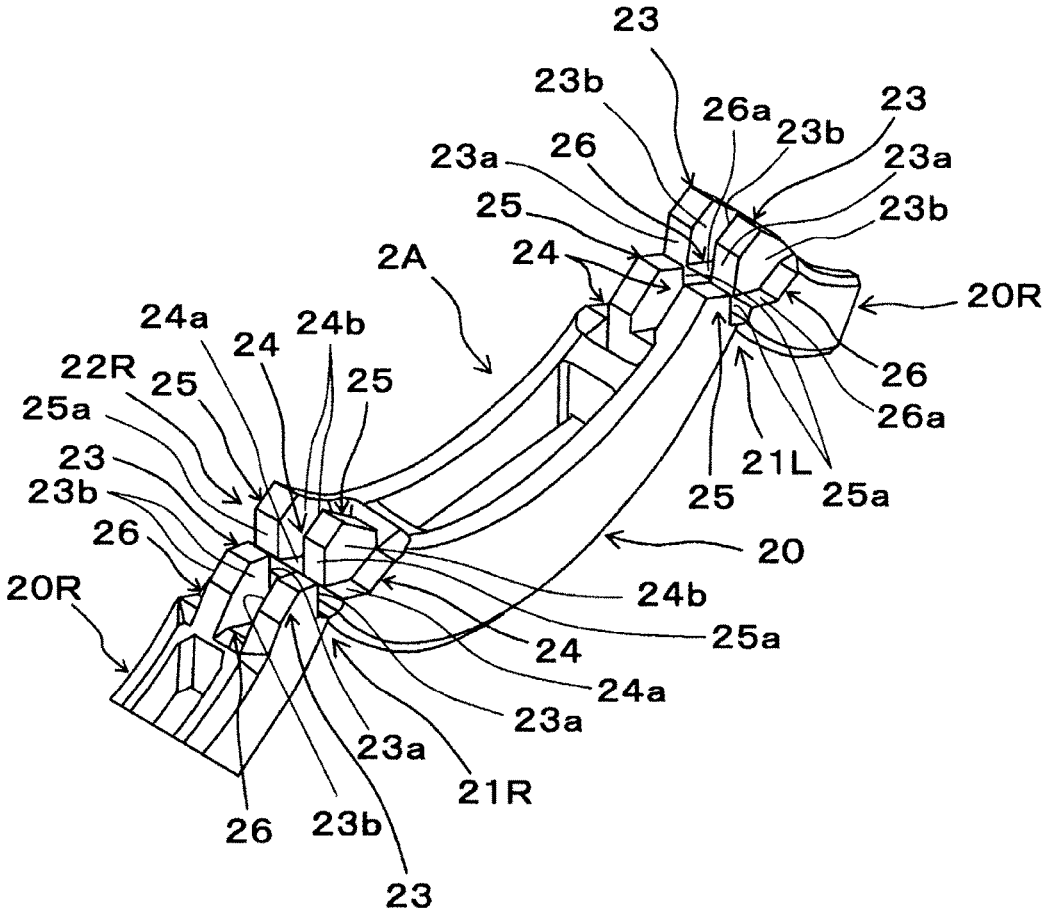
FIG. 21 is a perspective view showing a main configuration of the binding component of another modified example.

FIG. 18 is a perspective view showing a modified example of the binding component of the present embodiment, and FIG. 19 is a perspective view showing a main configuration of a binding component of the modified example. Further, FIG. 20 is a perspective view showing another modified example of the binding component of the present embodiment, and FIG. 21 is a perspective view showing a main configuration of a binding component of another modified example. The binding component 1A of the embodiment shown in FIG. 1 or the like has a configuration that one first fitting convex portion 23 is provided in each of the first ring arm portion 20R and the second ring arm portion 20L, one first fitting concave portion 24 is provided in the ring back portion 20, two second fitting convex portions 25 are provided in the ring back portion 20, and two second fitting concave portions 26 are provided in each of the first ring arm portion 20R and the second ring arm portion 20L.

On the contrary, in the modified example shown in FIG. 18 and FIG. 19, one first fitting convex portion 23 is provided in each of the first ring arm portion 20R and the second ring arm portion 20L, and one first fitting concave portion 24 is provided in the ring back portion 20. Further, one second fitting convex portion 25 is provided in the ring back portion 20 while being adjacent to the first fitting concave portion 24. One second fitting concave portion 26 is provided in each of the first ring arm portion 20R and the second ring arm portion 20L while being adjacent to the first fitting convex portion 23.

Also in the configuration shown in FIG. 18 and FIG. 19, when the first fitting convex portion 23 is fitted into the first fitting concave portion 24, the first convex-side load receiving surface 23*a* of the first fitting convex portion 23 comes into contact with the first concave-side load receiving surface 24*a* of the first fitting concave portion 24. Further, the third convex-side load receiving surface 23*b* of the first fitting convex portion 23 comes into contact with the third concave-side load receiving surface 24*b* of the first fitting concave portion 24.

Additionally, when the second fitting convex portion 25 is fitted into the second fitting concave portion 26, the second convex-side load receiving surface 25*a* of the second fitting convex portion 25 comes into contact with the second concave-side load receiving surface 26*a* of the second fitting concave portion 26.

Accordingly, in the process of closing the first ring arm portion 20R and the second ring arm portion 20L, the first fitting convex portion 23 and the first fitting concave portion 24, and the second fitting convex portion 25 and the second fitting concave portion 26 serve as a guide in a width direction and a thickness direction.

Further, when a load of the impact such as dropping is applied, from any direction, to places where the first ring arm portion 20R and the ring back portion 20 are connected to each other and where the second ring arm portion 20L and the ring back portion 20 are connected to each other, this load is received by a combination of any one of the convex-side load receiving surfaces and the concave-side load receiving surfaces, so that the load applied to the hinge portions 21L, 21R is reduced.

In the modified example shown in FIG. 20 and FIG. 21, two first fitting convex portions 23 are provided in each of the first ring arm portion 20R and the second ring arm portion 20L and two first fitting concave portions 24 are provided in the ring back portion 20. Further, two second fitting convex portions 25 are provided in the ring back portion 20 and two second fitting concave portions 26 are provided in each of the first ring arm portion 20R and the second ring arm portion 20L.

Also in the configuration shown in FIG. 20 and FIG. 21, when the first fitting convex portion 23 is fitted into the first fitting concave portion 24, the first convex-side load receiving surface 23*a* of the first fitting convex portion 23 comes into contact with the first concave-side load receiving surface 24*a* of the first fitting concave portion 24. Further, the third convex-side load receiving surface 23*b* of the first fitting convex portion 23 comes into contact with the third concave-side load receiving surface 24*b* of the first fitting concave portion 24.

Additionally, when the second fitting convex portion 25 is fitted into the second fitting concave portion 26, the second convex-side load receiving surface 25*a* of the second fitting convex portion 25 comes into contact with the second concave-side load receiving surface 26*a* of the second fitting concave portion 26.

Accordingly, in the process of closing the first ring arm portion 20R and the second ring arm portion 20L, the first fitting convex portion 23 and the first fitting concave portion 24, and the second fitting convex portion 25 and the second fitting concave portion 26 serve as a guide in a thickness direction.

Further, when a load of the impact such as dropping is applied, from any direction, to places where the first ring arm portion 20R and the ring back portion 20 are connected to each other and where the second ring arm portion 20L and the ring back portion 20 are connected to each other, this load is received by a combination of any one of the convex-side load receiving surfaces and the concave-side load receiving surfaces, so that the load applied to the hinge portions 21L, 21R is reduced.

<Configuration Example of Paper Processing Device>

Figure 22:
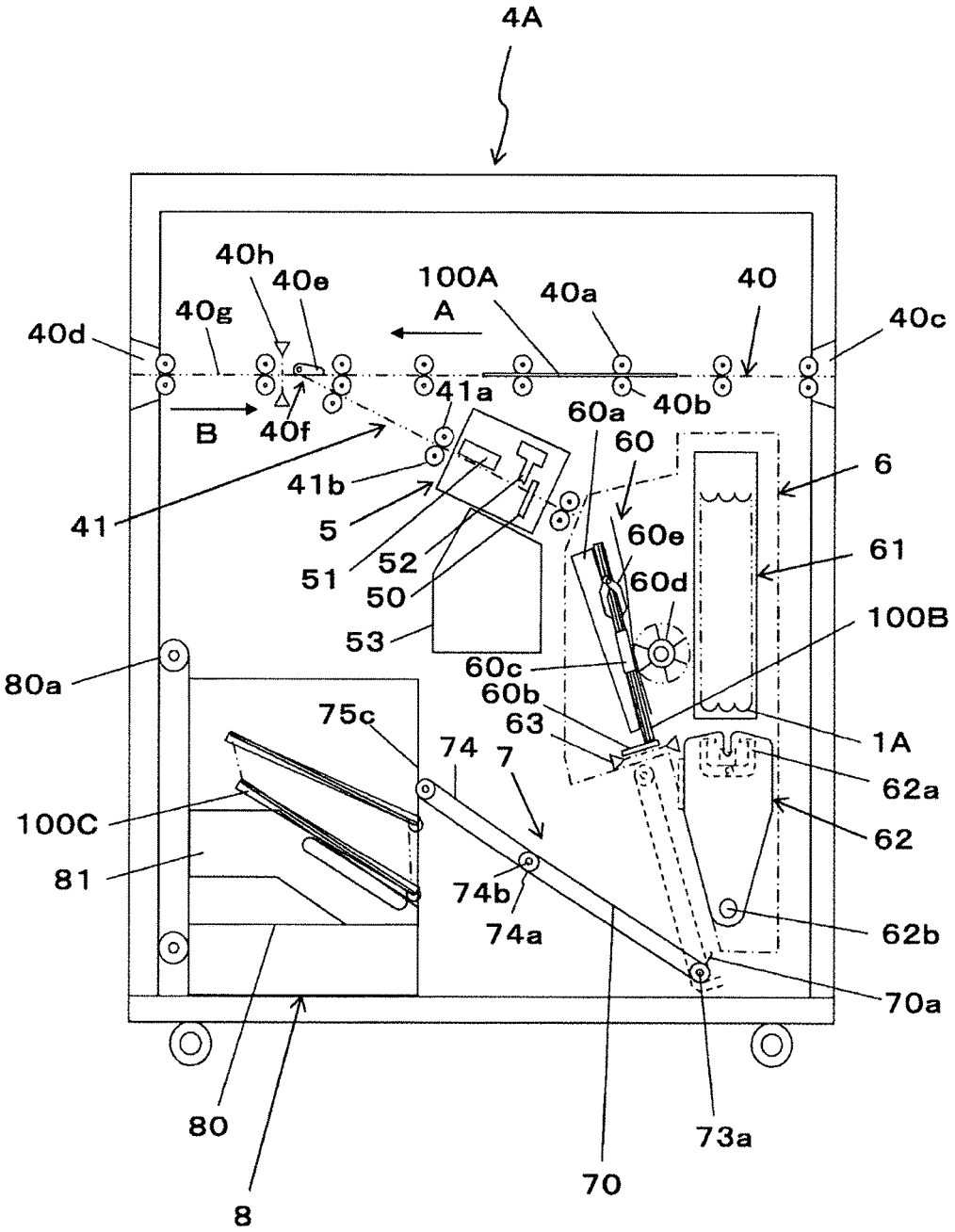
FIG. 22 is a configuration view showing an example of a paper processing device.

FIG. 22 shows a configuration view showing an example of a paper processing device where the binding component of the present embodiment is used. FIG. 22 shows an outline of an internal configuration of the paper processing device.

A paper processing device 4A includes a first conveying path 40 for conveying a paper 100A and a second conveying path 41 branched from the first conveying path 40. The paper processing device 4A constitutes a conveying route that is referred to as a switchback type or the like for reversing a conveying direction of papers in the middle. Here, the papers refer to general terms including one sheet of paper 100A, a paper bundle 100B obtained by integrating the paper 100A, and a booklet 100C obtained by binding the paper bundle 100B by the binding component 1A, or the like.

Further, the paper processing device 4A includes a punching unit 5 for drilling a hole in the paper 100A, a binder unit 6 for binding the paper bundle 100B and making a booklet, a discharging unit 7 for conveying the bound booklet 100C or the like, and a paper discharge stacker 8 for storing the booklet 100C or the like. The paper bundle 100B is obtained by aligning a plurality of sheets of paper drilled with holes.

The first conveying path 40 is disposed at an upper side of the paper processing device 4A. The first conveying path 40 includes a plurality of feed rollers 40*a* that is rotationally driven, a plurality of guide rollers 40*b* facing the feed rollers 40*a*, and a guide member (not shown), or the like. The first conveying path 40 constitutes a linear conveying route for conveying the paper between a feeding port 40*c* and a discharge port 40*d*. The conveying route is substantially horizontal.

The first conveying path 40 includes a switching blade 40*e* for switching a conveying direction A. The switching blade 40*e* is disposed at a downstream side in the conveying direction A from the feeding port 40*c* side toward the discharge port 40*d* side. A branch portion 40*f* of the first conveying path 40 and the second conveying path 41 is formed. Further, in the first conveying path 40, a reversal holding unit 40*g* is formed between the downstream of the branch portion 40*f* and the discharge port 40*d*.

At the branch portion 40*f*, the second conveying path 41 is branched downward from the first conveying path 40. The second conveying path 41 includes a plurality of feed rollers 41*a* that is rotationally driven, a plurality of guide rollers 41*b* facing the feed rollers 41*a*, and a guide member (not shown), or the like.

The second conveying path 41 is branched in an opposite direction with respect to the conveying direction A of the first conveying path 40. The second conveying path 41 is communicated with the reversal holding unit 40*g* by the operation of the switching blade 40*e*.

The switching blade 40*e* is rotationally driven to move between a position retracted from the first conveying path 40 and a position protruding into the first conveying path 40.

When the switching blade 40*e* is switched to the position retracted from the first conveying path 40, the paper 100A, which is conveyed in the first conveying path 40 in the conveying direction A from the feeding port 41*c*, is moved through the switching blade 40*e* and conveyed to the reversal holding unit 40*g*.

On the contrary, when the switching blade 40*e* is switched to the position protruding into the first conveying path 40, the paper 100A is conveyed in the first conveying path 40 in a conveying direction B from the reversal holding unit 40*g* while reversing the conveying direction. Then, the paper 100A is sent to the second conveying path 41 from the first conveying path 40 by the guide of the switching blade 40*e*.

As a result, the second conveying path 41 constitutes a conveying route where the conveying direction of the paper 100A that is conveyed in the conveying direction A from the feeding port 40*c* side to the discharge port 40*d* side through the first conveying path 40 is switched to the conveying direction B at the reversal holding unit 40*g* and the paper 100A is switched back downward from the first conveying path 40.

The first conveying path 40 includes a paper detection sensor 40*h* at the reversal holding unit 40*g*. The paper detection sensor 40*h* detects whether or not a rear end of the paper 100A that is conveyed in the conveying direction A through the first conveying path 40 is conveyed up to the position where the paper passes through the switching blade 40*e*.

The punching unit 5 is disposed in the second conveying path 41. The punching unit 5 includes an abutting shutter 50 for aligning the position of leading ends in the conveying direction of the paper 100A, a width aligning mechanism 51 for aligning the paper 100A in the lateral direction and a punch blade 52 for drilling holes in the paper 100A, or the like.

The abutting shutter 50 is configured to open and close the punching unit 5 by moving between a protruding position where the abutting shutter 50 protrudes into the second conveying path 41 and a retracted position where the abutting shutter 50 is retracted from the second conveying path 41. In the protruding position, the paper 100A sent to the punching unit 5 is abutted against the abutting shutter 50. In the retracted position, the paper 100A can pass through the abutting shutter 50. When the abutting shutter 50 protrudes into the second conveying path 41, the leading end of the paper 100A conveyed through the second conveying path 41 is abutted against the abutting shutter, so that the leading end of the paper 100A is restricted to a predetermined position.

The width aligning mechanism 51 includes a width aligning guide at one side of the left and right to the conveying direction of the paper 100A and a reference guide at the other side thereof. The width aligning guide moves in a direction of approaching and separating from the reference guide, so that the paper 100A sent to the punching unit 5 is abutted against the reference guide.

The punch blade 52 is configured to reciprocate in a direction perpendicular to the plane of the paper 100A conveyed through the second conveying path 41. The aligning of the paper 100A is carried out by the abutting shutter 50 and the width aligning mechanism 51. In this state, predetermined holes are drilled in the paper 100A when the punch blade 52 is reciprocated.

Meanwhile, in order to collect punch debris generated when drilling holes in the paper 100A by the punch blade 52, a punch debris stacker 53 is provided below the punching unit 5.

The binder unit 6 is an example of a binding means and is disposed at a downstream side of the punching unit 5. The binder unit 6 includes a paper aligning part 60, a binding component stacker 61, and a binding part 62. The paper aligning part 60 is configured to align and integrate a plurality of sheets of paper with holes drilled by the punching unit 5. The binding component stacker 61 is configured to store the binding component 1A for binding the papers. The binding part 62 is configured to bind, by the binding component 1A, the paper bundle 100B that is aligned and integrated by the paper aligning part 60.

The paper aligning part 60 includes, in a paper temporary holding portion 60*a*, an abutting shutter 60*b* for aligning the position of leading ends in the conveying direction of the paper, a width aligning mechanism 60*c* for aligning the position in the lateral direction of the paper, a paddle mechanism 60*d* for causing the paper to be abutted against the abutting shutter 60*b*, and a clamp mechanism 60*e* for holding booklets such as the booklet 100C or the paper bundle 100B.

The abutting shutter 60*b* is configured to open and close the temporary holding portion 60*a* by moving between a protruding position where the abutting shutter 60*b* protrudes into the temporary holding portion 60*a* and a retracted position where the abutting shutter 60*b* is retracted from the temporary holding portion 60*a*. In the protruding position, the paper sent to the paper aligning part 60 is abutted against the abutting shutter 60*b*. In the retracted position, the booklet can pass through the abutting shutter 60*b*.

The width aligning mechanism 60*c* includes a width aligning guide at one side of the left and right to the conveying direction of the paper and a reference guide at the other side thereof. The width aligning guide moves in a direction of approaching and separating from the reference guide, so that the paper sent to the binder unit 6 is abutted against the reference guide.

The paddle mechanism 60*d* includes a paddle roller where a plurality of tongue pieces is arranged in a circumferential direction. The paddle roller is rotationally driven. The paddle roller scrapes the paper sent to the paper aligning part 60 and causes the paper to be abutted against the abutting shutter 60*b* that protrudes into the temporary holding portion 60*a*. Meanwhile, a rotation shaft of the paddle roller is inclined in a guide direction of the fixed side of the width aligning mechanism 60*c*. Further, the paddle roller applies a force to the paper sent to the paper aligning part 60. The force causes the paper to be abutted in the guide direction of the fixed side of the width aligning mechanism 60*c*.

The clamp mechanism 60*e* clamps and holds the paper bundle 100B that is sent to the paper aligning part 60 and aligned by the abutting shutter 60*b*, the width aligning mechanism 60*c* and the paddle mechanism 60*d*. The clamp mechanism 60*e* is configured to move the paper bundle 100B held to a predetermined processing position.

A plurality of binding components 1A is vertically stacked and stored in the binding component stacker 61. The binding component stacker 61 is provided at its bottom with an outlet for the binding component 1A. The binding component stacker 61 is configured to feed the binding component 1A one by one in cooperation with the binding part 62.

The binding part 62 includes a binding mechanism 62*a* for feeding and binding the binding component 1A stored in the binding component stacker 61. The binding part 62 is rotated about a rotation supporting point 62*b* by being rotationally driven. In this way, the binding part 62 moves between a binding component feeding position where the binding mechanism 62*a* faces the binding component stacker 61 and a paper binding position where the binding mechanism 62*a* faces the paper aligning part 60.

At the position where the binding mechanism 62*a* faces the binding component stacker 61, the binding mechanism 62*a* is configured to extract and hold the binding component 1A from the binding component stacker 61. At the position where the binding mechanism 62*a* faces the paper aligning part 60, the binding mechanism 62*a* is configured to bind, by the binding component 1A, the paper bundle 100B aligned and held by the paper aligning part 60.

The binder unit 6 includes a paper detection sensor 63 in a conveying route from the paper aligning part 60 to the discharging unit 7. The paper detection sensor 63 is an example of a paper detection means. The paper detection sensor 63 detects whether or not the booklets, such as the booklet 100C that is aligned by the paper aligning part 60 and bound by the binding component 1A or the paper bundle 100B that is aligned by the paper aligning part 60 but not bound, are conveyed to the discharging unit 7.

The discharging unit 7 is disposed at a downstream side of the binder unit 6. The discharging unit 7 constitutes the paper processing device 4A that receives booklets by using the binder unit 6 as a first device. The paper processing device 4A reverses the conveying direction of the booklets and discharges the booklets to the paper discharge stacker 8.

The paper processing device 4A includes a belt conveying mechanism 70 and a belt conveying mechanism 74, or the like. The belt conveying mechanism 70 receives the booklets from the binder unit 6, switches the conveying direction of the booklets and conveys the booklets. The belt conveying mechanism 74 receives the booklets from the belt conveying mechanism 70 and discharges the booklets to the paper discharge stacker 8.

In the belt conveying mechanism 70, an endless conveying belt equipped with a receiving tool 70*a* is wound around a pair of pulleys that is rotationally driven. The receiving tool 70*a* of the belt conveying mechanism 70 has a shape of supporting an end surface side of the booklets. When the belt conveying mechanism 70 is rotationally driven in a predetermined direction, the receiving tool 70*a* protrudes from a guide surface and moves in the conveying direction.

In the belt conveying mechanism 70, a lower end that is one end in the conveying direction of the booklet is pivotally supported to a frame of the paper processing device 4A via a first rotation supporting point 73*a*.

The belt conveying mechanism 70 is pivoted about the first rotation supporting point 73*a*. The belt conveying mechanism 70 moves between a paper receiving position (indicated by a broken line in FIG. 22) where the belt conveying mechanism 70 forms the conveying route from the binder unit 6 and a paper discharging position (indicated by a solid line in FIG. 22) where the belt conveying mechanism 70 forms the conveying route to a second paper discharge conveying path 11.

In the belt conveying mechanism 74, an endless conveying belt equipped with a receiving tool 74*a* is wound around a pair of pulleys that is rotationally driven. The receiving tool 74*a* of the belt conveying mechanism 74 has a shape of supporting an end surface side of the booklets. The receiving tool 74*a* moves in the conveying direction when the belt conveying mechanism 74 is rotationally driven in a predetermined direction.

Here, in the belt conveying mechanism 74, a pulley 74*b* on the first paper discharge path 10 side is extended to a position where the pulley enters the first paper discharge path 10. The belt conveying mechanism 74 can convey the booklet between the first paper discharge path 10 that is displaced to the paper discharging position and the second paper discharge path 11.

The paper discharge stacker 8 is disposed at a downstream side of the discharging unit 7 and includes a stacking stage 80. The stacking stage 80 includes a tray 81 that can be pulled out in the front direction of the device. The stacking stage 80 is configured to be vertically lifted by a stage lifting mechanism 80*a*.

As described above, in the paper processing device 4A having a switchback type conveying route, a desired conveying route can be configured by a combination of linear conveying routes or curved conveying routes having a large radius without providing a conveying route where the booklets, such as the booklet 100C that is obtained by integrating and binding a plurality of sheets of paper 100A or the paper bundle 100B that is obtained by integrating a plurality of sheets of paper 100A, are tightly bent.

<Operation Example of Paper Processing Device>

Next, an operation example where the paper is bound by the paper processing device 4A will be described with reference to each drawing.

The paper processing device 4A is connected to a copying machine or the like (not shown). The paper 100A that is subjected to a predetermined processing such as printing is fed one by one to the paper processing device 4A from the feeding port 40*c*. In an operation of binding the paper by the binding component 1A, a conveying process of conveying the paper 100A to the punching unit 5 is performed, a drilling process is performed by the punching unit 5 and then an aligning process is performed by the binder unit 6.

Figure 23:
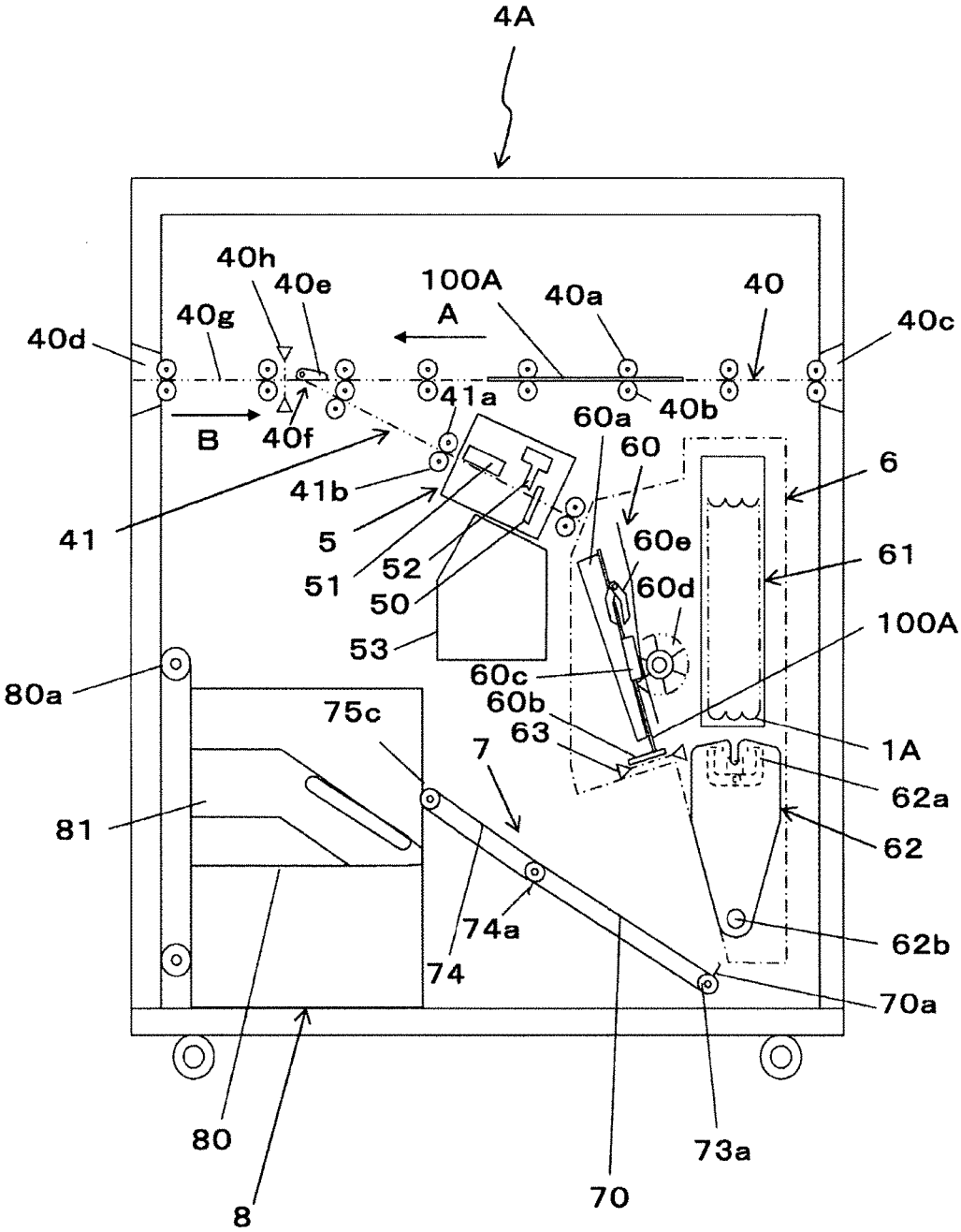
FIG. 23 is an operation explanatory view showing an example of operations from a conveying process to an aligning process in the paper processing device.

FIG. 23 is an operation explanatory view showing an example of operations from the conveying process to the aligning process in the paper processing device 4A.

In the conveying process of conveying the paper 100A to the punching unit 5, the feed rollers 40*a* in the first conveying path 40 are rotationally driven. The feed rollers 40*a* are rotated in a forward rotation direction and the paper 100A in the first conveying path 40 is thus conveyed in the conveying direction A.

As a result, the paper 100A fed to the first conveying path 40 is sandwiched between the guide roller 40*b* and the feed roller 40*a* that is rotationally driven in the forward rotation direction. The paper 100A is guided by a guide member (not shown) and conveyed in the conveying direction A from the feed port 40*c* to the discharge port 40*d* through the first conveying path 40.

A rear end of the paper 100A that is conveyed in the conveying direction A through the first conveying path 40 is detected by the paper detection sensor 40*h*. When it is determined that the paper 100A is moved through the switching blade 40*e* and conveyed to the reversal holding unit 40*g*, the conveying of the paper 100A is temporarily stopped.

After the conveying of the paper 100A is temporarily stopped, the switching blade 40*e* is rotationally driven. In this way, the conveying route from the reversal holding unit 40*g* to the second conveying path 41 is opened, so that the conveying direction is switched.

When the switching blade 40*e* is rotationally driven and the conveying direction is thus switched to the second conveying path 41, the feed rollers 40*a* are rotated in a rearward rotation direction and the paper 100A in the first conveying path 40 is thus conveyed in the conveying direction B. Further, the feed rollers 41*a* in the second conveying path 41 are rotationally driven. The feed rollers 41*a* are rotated in a direction in which the paper 100A in the second conveying path 41 is conveyed to the punching unit 5.

In this way, the conveying direction of the paper 100A that is temporarily held in the reversal holding unit 40*g* is switched, so that the paper is conveyed in the conveying direction B. Then, the paper 100A is guided by the switching blade 40*e* and sent from the first conveying path 40 to the second conveying path 41.

The paper 100A sent to the second conveying path 41 is sandwiched between the feed roller 41*a* and the guide roller 41*b*, guided by a guide member (not shown) and conveyed to the punching unit 5 through the second conveying path 41.

In order to perform the drilling process of drilling holes in the paper 100A, the punching unit 5 causes the abutting shutter 50 to protrude into the conveying route of the paper 100A and drives the width aligning mechanism 51.

In this way, a leading end of the paper 100A conveyed to the punching unit 5 is abutted against the abutting shutter 50 and a side end thereof is abutted against a reference guide (not shown), so that the alignment of the paper is performed.

When the alignment of the paper 100A is performed, the punch blade 52 is driven to drill predetermined holes in the paper 100A. Then, the abutting shutter 50 is opened. When the abutting shutter 50 is opened, the paper 100A that is drilled by the punching unit 5 is conveyed to the binder unit 6.

In order to perform the aligning process of integrating and aligning a predetermined number of papers 100A drilled with holes, first, the binder unit 6 causes the abutting shutter 60*b* to protrude into the temporary holding portion 60*a* and drives the width aligning mechanism 60*c* and the paddle mechanism 60*d*.

In this way, a leading end of the paper 100A that is drilled by the punching unit 5 and conveyed to the binder unit 6 is abutted against the abutting shutter 60*b* and a side end thereof is abutted against a reference guide (not shown), so that the alignment of the paper is performed.

When the alignment of the paper 100A is performed, the clamp mechanism 60*e* is closed. When the clamp mechanism 60*e* is closed, the paper 100A aligned is clamped and held by the clamp mechanism 60*e* without causing a positional deviation.

Then, the conveying process, the punching process and the aligning process, which are described above, are repeated until a predetermined number of papers 100A are aligned and integrated in the temporary holding portion 60*a*.

When the papers 100A drilled with holes are sequentially conveyed to the temporary holding portion 60*a* and a predetermined number of papers 100A is aligned and held by the clamp mechanism 60*e*, a series of conveying process, punching process and aligning process are stopped.

Figure 24:
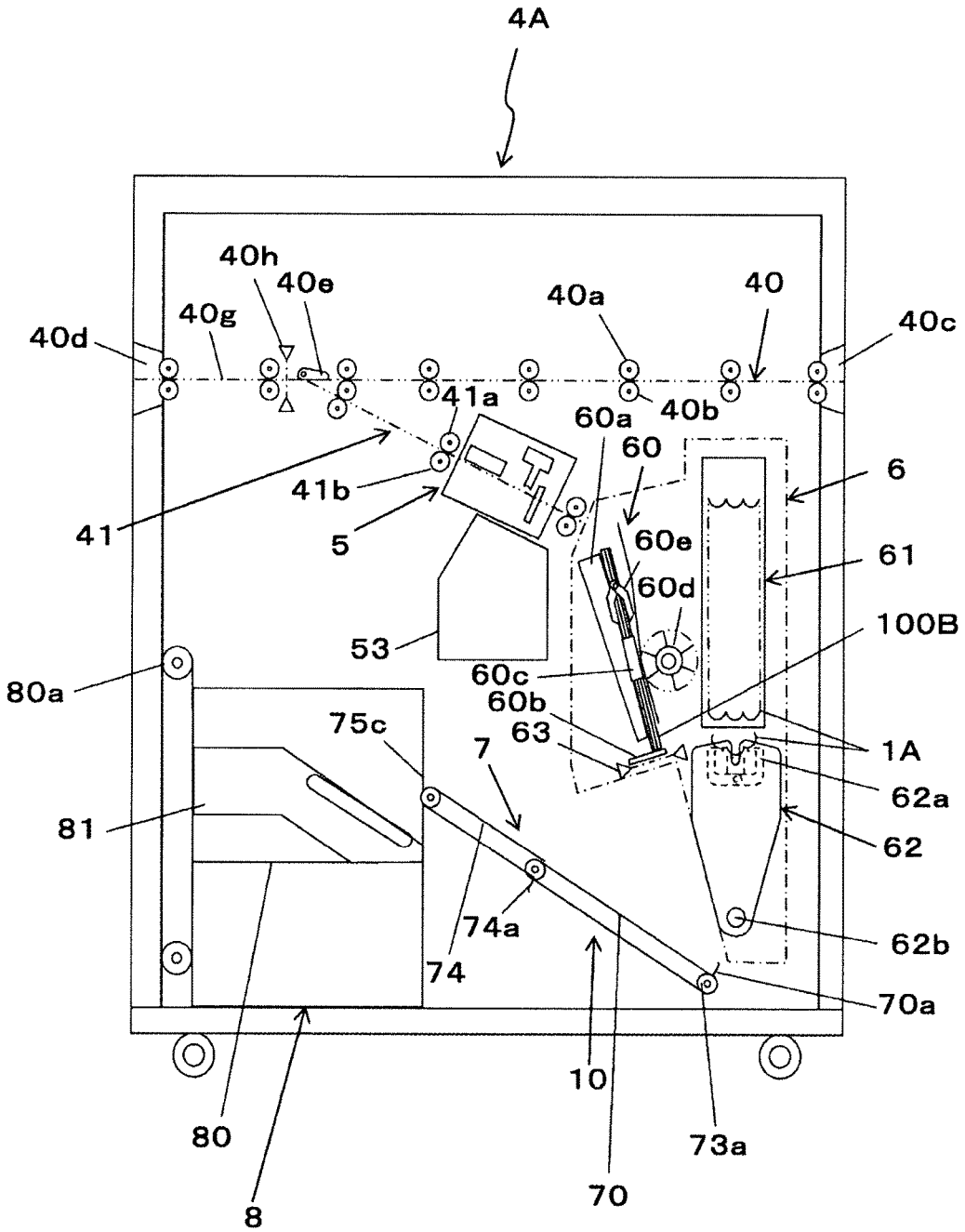
FIG. 24 is an operation explanatory view showing an example of a binding process in the paper processing device.
Figure 25:
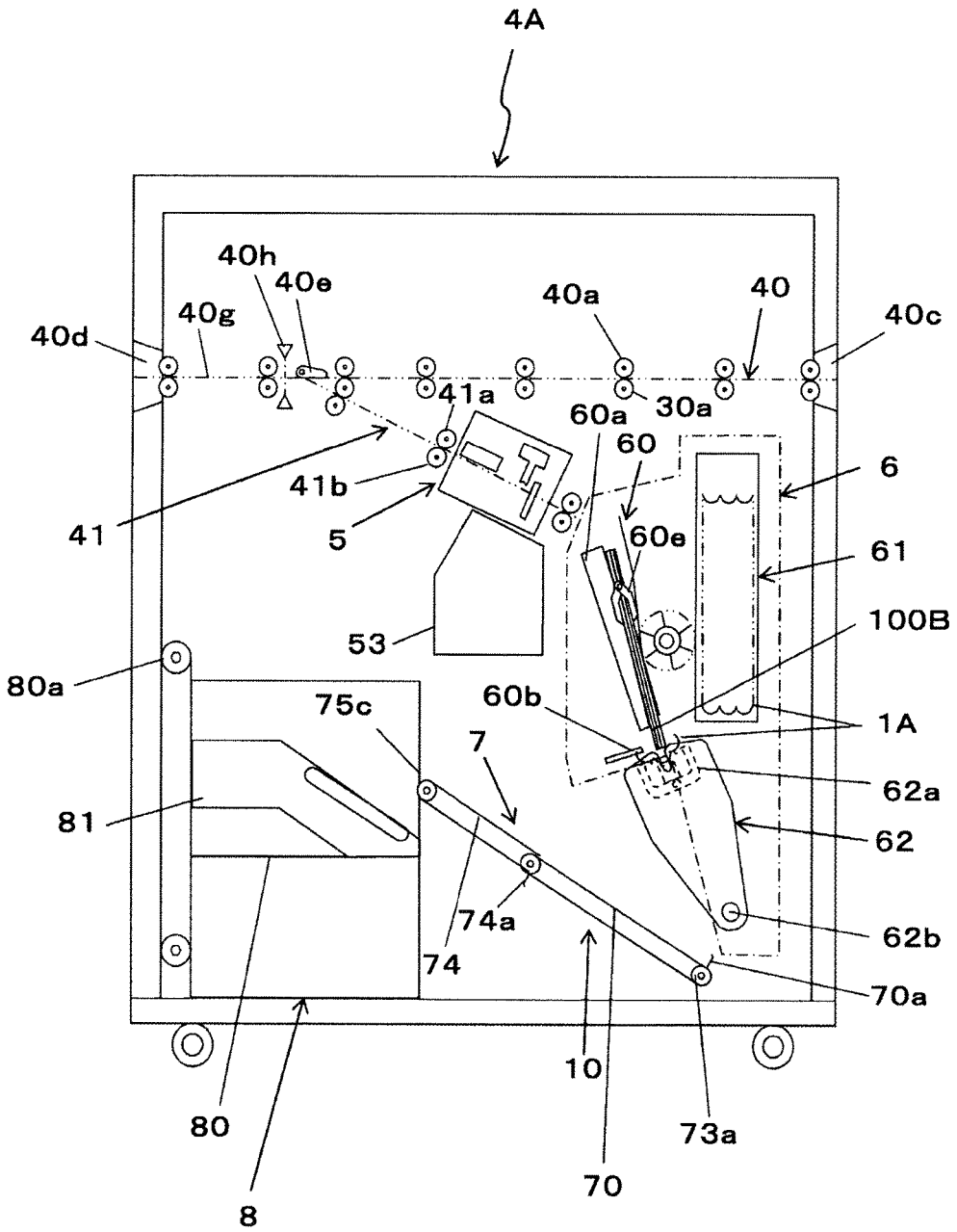
FIG. 25 is an operation explanatory view showing an example of a binding process in the paper processing device.

FIG. 24 and FIG. 25 are operation explanatory views showing an example of a binding process in the paper processing device 4A. FIG. 24 shows an operation of extracting the binding component 1A from the binding component stacker 61 and FIG. 25 shows an operation of binding the paper bundle 100B by the binding component 1A.

In the binder unit 6, the binding part 62 is on standby at a binding component extraction position. Then, in order to perform the binding process of binding a predetermined number of papers 100A by the binding component 1A, the binding mechanism 62*a* is driven. The binding mechanism 62*a* grasps a back part 3A (shown in FIG. 3, etc.) of the binding component 1A stored in the binding component stacker 61 by a predetermined operation. Then, as schematically shown in FIG. 24, the binding mechanism 62*a* extracts and holds one binding component 1A from the binding component stacker 61.

When the binding component 1A is extracted from the binding component stacker 61, the binding part 62 is rotationally driven. As shown in FIG. 25, the binding part 62 is pivoted about the rotation supporting point 62*b* and moved to the paper binding position.

Subsequently, the clamp mechanism 60*e* is driven and the paper bundle 100E aligned and held is moved to a predetermined processing position. The binding mechanism 62*a* is driven to press the first ring arm portion 20R and the second ring arm portion 20L (as shown in FIG. 3, etc.) of the binding component 1A in a closing direction. The first locking portion 27*a* and the second locking portion 27*b* are locked to bind the paper bundle 100B by the binding component 1A. In this way, the booklet 100C where the paper bundle 100B is bound by the binding component 1A is obtained.

Figure 26:
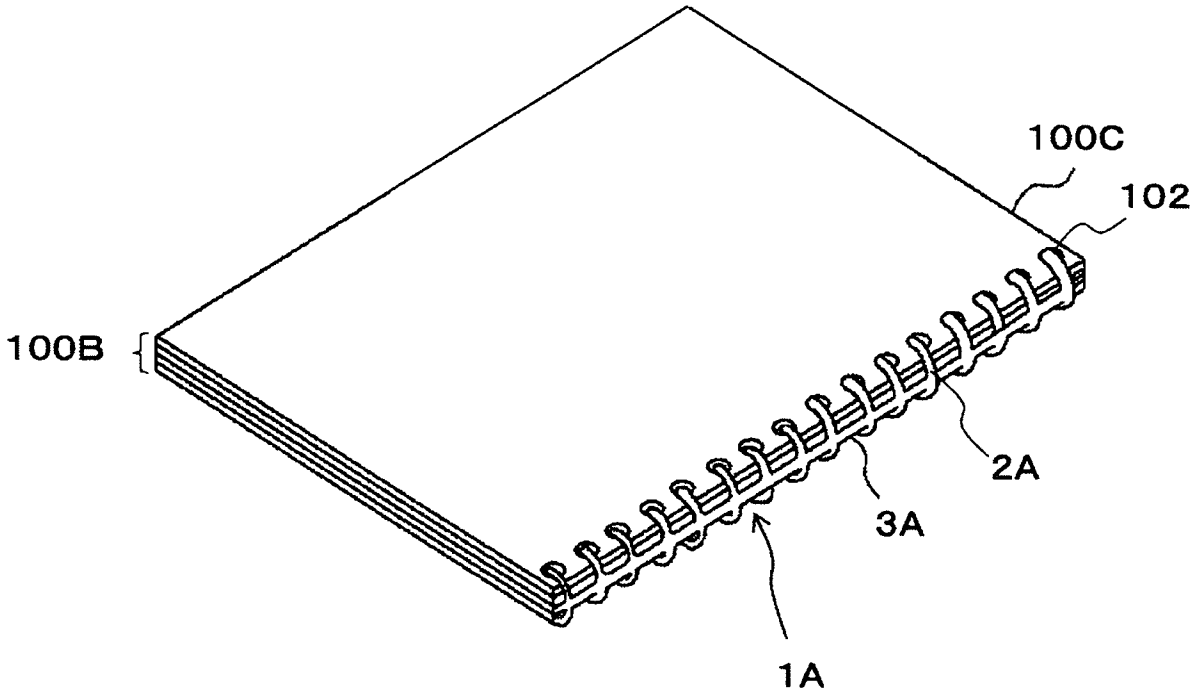
FIG. 26 is a perspective view showing an example of a booklet.

FIG. 26 is a perspective view showing an example of the booklet 100C. The booklet 100C is obtained by binding, by the binding component 1A, the paper bundle 100B where a plurality of sheets of paper drilled with the holes 102 is integrated. In the present embodiment, an example where the paper processing device 4A binds the paper bundle 100E by using the binding component 1A has been described. However, instead of the paper processing device 4A, a worker may bind the paper bundle 100B using the binding component 1A by his own hand.

Figure 27:
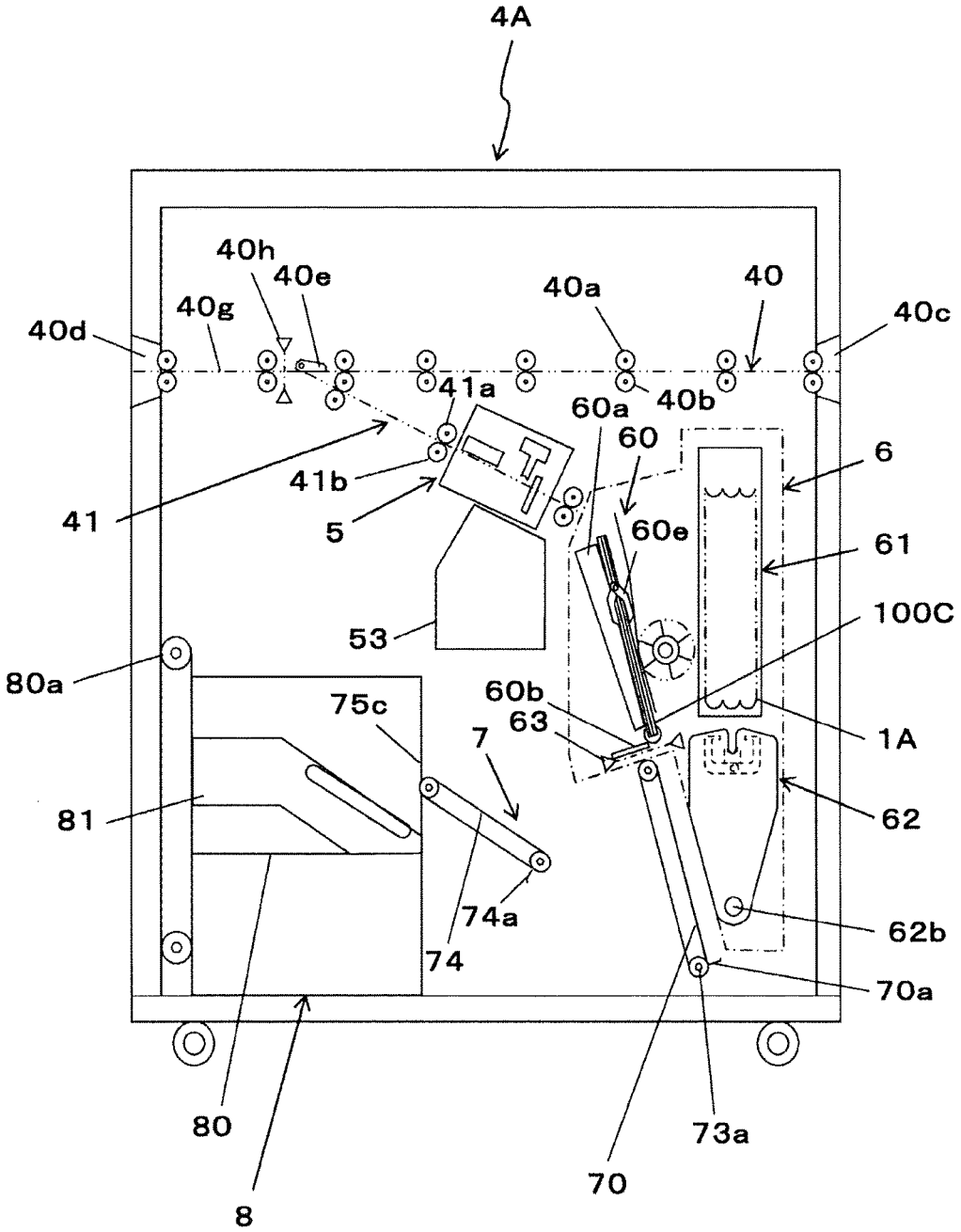
FIG. 27 is an operation explanatory view showing an example of a paper discharge process in the paper processing device.
Figure 28:
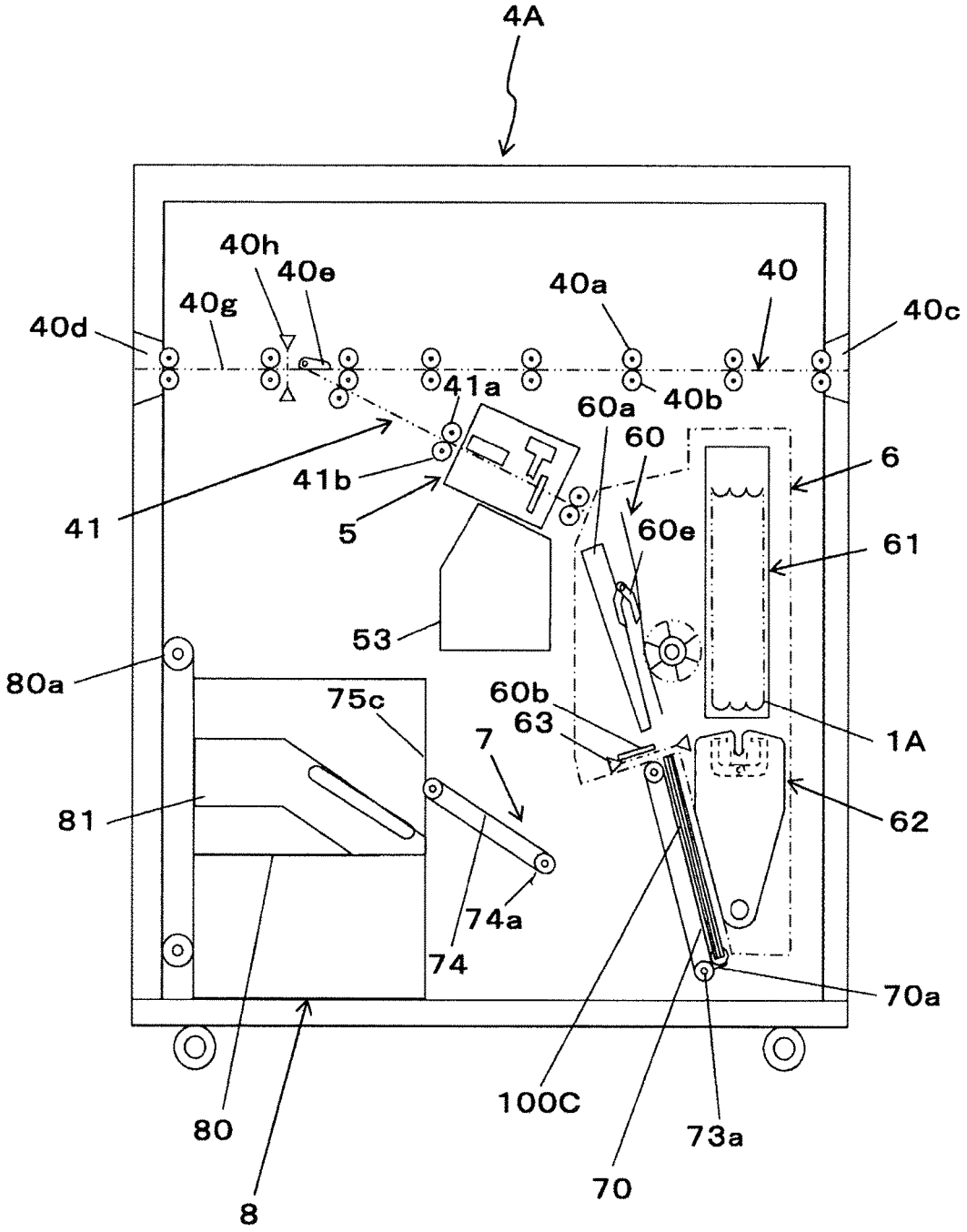
FIG. 28 is an operation explanatory view showing an example of a paper discharge process in the paper processing device.
Figure 29:
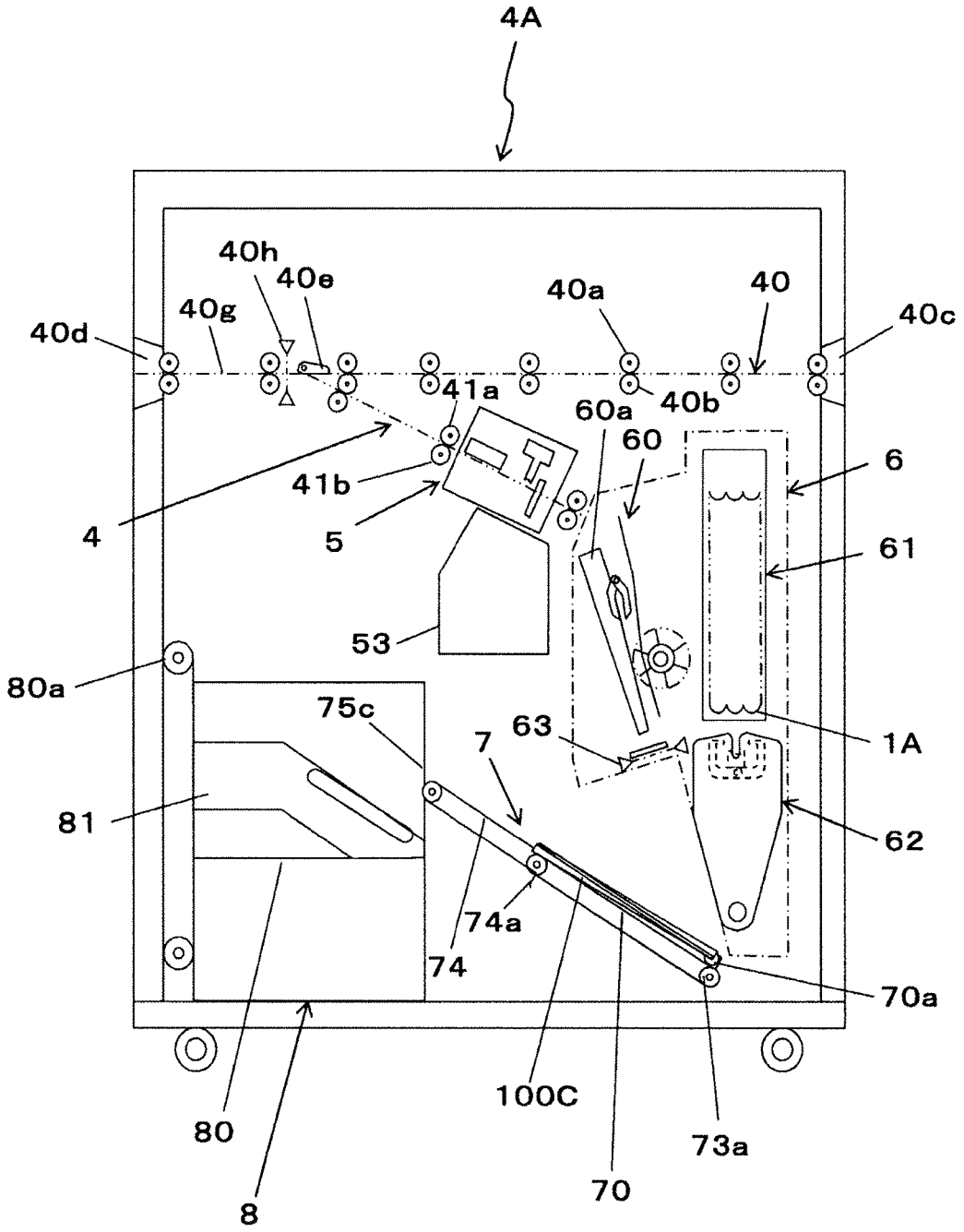
FIG. 29 is an operation explanatory view showing an example of a paper discharge process in the paper processing device.
Figure 30:
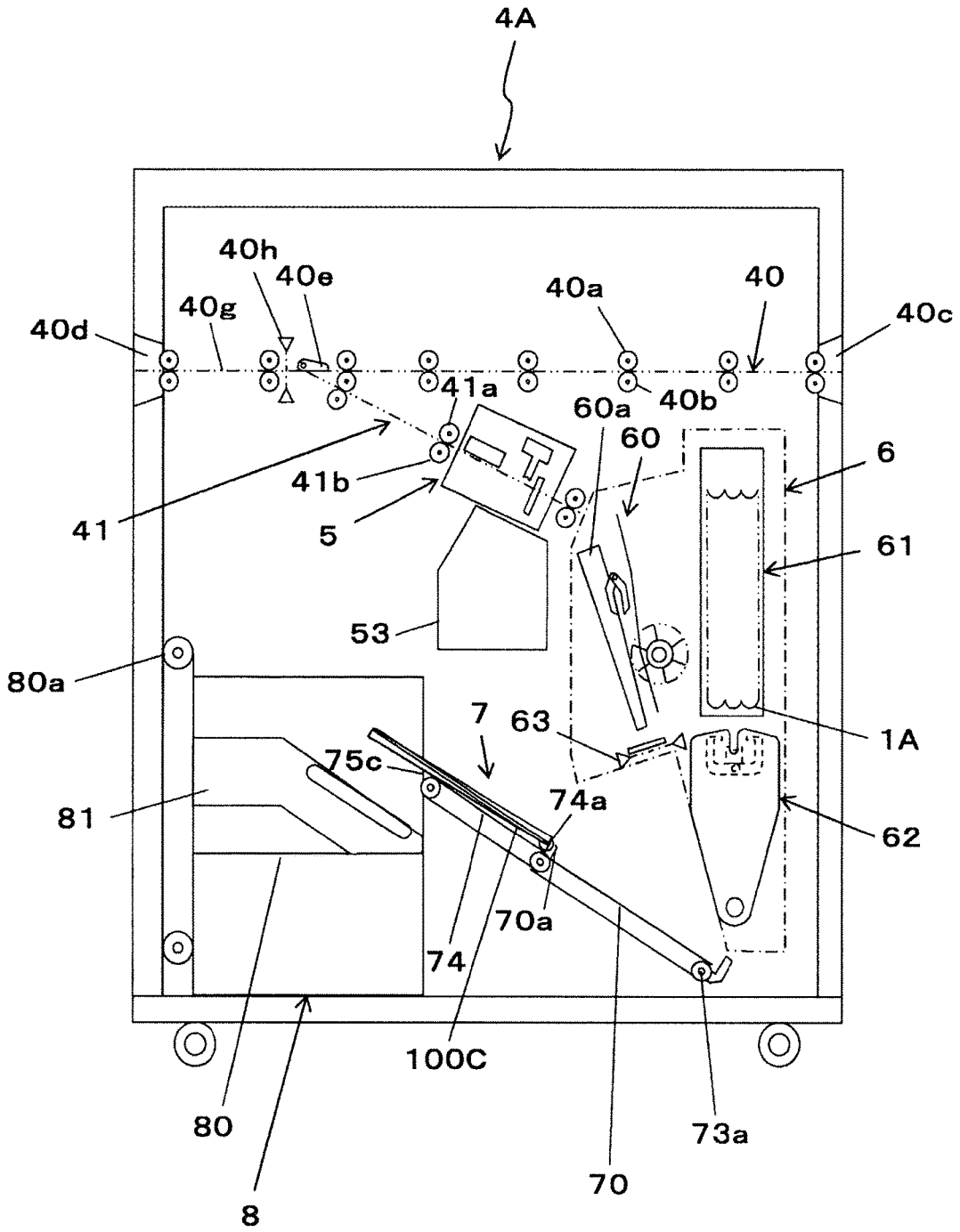
FIG. 30 is an operation explanatory view showing an example of a paper discharge process in the paper processing device.
Figure 31:
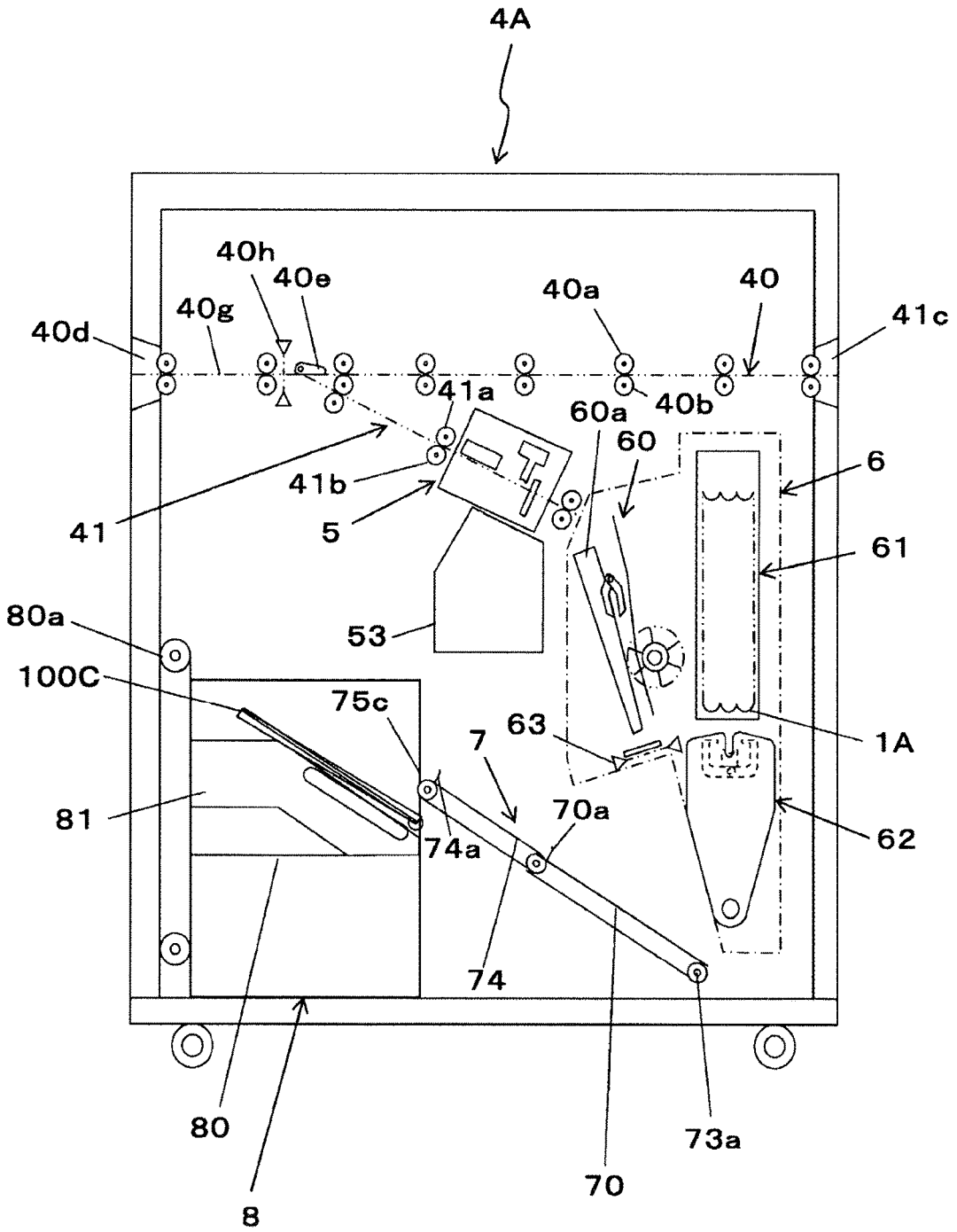
FIG. 31 is an operation explanatory view showing an example of a paper discharge process in the paper processing device.

FIG. 27 to FIG. 31 are operation explanatory views showing an example of a paper discharging process in the paper processing device 4A. FIG. 27 shows an operation of moving the belt conveying mechanism 70 of the discharging unit 7 to a paper receiving position and FIG. 28 shows an operation of receiving the booklet 100C by the belt conveying mechanism 70. Further, FIG. 29 shows an operation of moving the belt conveying mechanism 70 to a paper discharging position, FIG. 30 shows an operation of conveying the booklet 100C by the discharging unit 7, and FIG. 31 shows an operation of discharging the booklet 100C to the paper discharging stacker 8.

When the paper bundle 100B is bound by the binding component 1A in the binder unit 6 and the booklet 100C is thus made, the binding part 62 is pivoted about the rotation supporting point 62*b* and moved to the binding component extraction position in order to perform the process of discharging the booklet 100C. Subsequently, the belt conveying mechanism 70 is pivoted about the first rotation supporting point 73*a* and moved to the paper receiving position, as shown in FIG. 27.

When the belt conveying mechanism 70 is moved to the paper receiving position, the clamp mechanism 60*e* is opened. When the clamp mechanism 60*e* is opened, the booklet 100C held in the temporary holding portion 60*a* by the clamp mechanism 60*e* drops, by its own gravity, to a conveying route formed by the belt conveying mechanism 70, as shown in FIG. 28.

When a rear end of the booklet 100C dropping from the temporary holding portion 60*a* is detected by the paper detection sensor 63 and it is determined that the booklet 100C is normally conveyed to the belt conveying mechanism 70, the belt conveying mechanism 70 is rotationally driven. Accordingly, as shown in FIG. 29, the belt conveying mechanism 70 is pivoted about the first rotation support point 73*a* and moved to the paper discharging position.

When the belt conveying mechanism 70 is moved to the paper discharging position, the belt conveying mechanism 70 is rotationally driven. When the belt conveying mechanism 70 is rotationally driven, the receiving tool 70*a* supports the booklet 100C and moves toward the belt conveying mechanism 74, so that the booklet 100C is conveyed to the belt conveying mechanism 74.

When the belt conveying mechanism 74 is rotationally driven, the receiving tool 74*a* receives the booklet 100C supported by the receiving tool 70*a* of the belt conveying mechanism 70, as shown in FIG. 30. The receiving tool 74*a* that receives the booklet 100C supports the booklet 100C and moves toward the paper discharge stacker 8, so that the booklet 100C is conveyed to the paper discharge stacker 8.

When the receiving tool 74*a* is moved to a predetermined position, the booklet 100C that is conveyed by the belt conveying mechanism 74 is discharged to the paper discharge stacker 8 from a discharge portion 75*c*, as shown in FIG. 31.

When the booklet 100*c* is conveyed to the paper discharge stacker 8, the stack stage 80 is lowered by a predetermined amount. In this way, a space for receiving the next booklet 100C is secured on the tray 81.

The present invention is applied to the binding component for binding a paper.

What is claimed is:

1. A binding component comprising:

ring back portions, each ring back portion having a first end and a second end, and configured to be a member of an annular ring part;

first ring arm portions, each first ring arm portion configured to be a member of the annular ring part and connecting to the first end of the ring back portion by a hinge portion;

second ring arm portions, each second ring arm portion configured to be a member of the annular ring part and connecting to the second end of the ring back portion by a hinge portion; and a back part to which the ring back portions are connected at predetermined intervals, wherein each annular ring part includes fitting portions (i) at a place where the first ring arm portion and the ring back portion are connected to each other and (ii) at a place where the second ring arm portion and the ring back portion are connected to each other, the fitting portions configured to fit together the first ring arm portion and the ring back portion, and the second ring arm portion and the ring back portion, by an operation of opening and closing the first ring arm portion and the second ring arm portion with (i) the hinge portion of the first end of the ring back portion as a support point and (ii) the hinge portion of the second end of the ring back portion as a support point, each fitting portion comprises:

at least one first fitting convex portion at an end of the first ring arm portion or at an end of the second ring arm portion, said end of the first ring arm portion or the second ring arm portion being opposite to the first end or the second end of the ring back portion;

at least one first fitting concave portion at the first end of the ring back portion opposite to the first ring arm portion or at the second end of the ring back portion opposite to the second ring arm portion, the first fitting convex portion having a shape configured to be fitted into the first fitting concave portion, and the first fitting concave portion having a corresponding shape configured to receive the first fitting convex portion;

at least one second fitting convex portion at the first end of the ring back portion opposite to the first ring arm portion or at the second end of the ring back portion opposite to the second ring arm portion; and at least one second fitting concave portion at the end of the first ring arm portion or at the end of the second ring arm portion, the second fitting convex portion having a shape configured to be fitted into the second fitting concave portion, and the second fitting concave portion having a corresponding shape configured to receive the second fitting convex portion, wherein the first fitting convex portion includes a first convex-side load receiving surface at an outwardly facing surface opposite to the first fitting concave portion, the first fitting concave portion includes a first concave-side load receiving surface at an inwardly facing surface opposite to the first convex-side load receiving surface, the second fitting convex portion includes a second convex-side load receiving surface at an outwardly facing surface opposite to the second fitting concave portion, the second fitting concave portion includes a second concave-side load receiving surface at an inwardly facing surface opposite to the second convex-side load receiving surface, the first fitting convex portion includes a third convex-side load receiving surface at a surface facing an axial direction of the annular ring part opposite to the first fitting concave portion, and the first fitting concave portion includes a third concave-side load receiving surface at a surface facing an axial direction of the annular ring part opposite to the third convex-side load receiving surface.

2. The binding component according to claim 1, wherein two second fitting concave portions are, respectively, provided at both sides of one first fitting convex portion in a width direction of the first ring arm portion and the second ring arm portion, the width direction of the first ring arm portion and the second ring arm portion being an axial direction of the first ring arm portion and the second ring arm portion, and two second fitting convex portions are, respectively, provided at both sides of one first fitting concave portion in a width direction of the ring back portion, the width direction of the ring back portion being an axial direction of the ring back portion.

3. The binding component according to claim 1, wherein the first fitting convex portion and the second fitting concave portion are provided in an alternating manner along a width direction of the first ring arm portion and the second ring arm portion, the width direction of the first ring arm portion and the second ring arm portion being an axial direction of the first ring arm portion and the second ring arm portion, and the first fitting concave portion and the second fitting convex portion are provided in an alternating manner in a width direction of the ring back portion, the width direction of the ring back portion being an axial direction of the ring back portion.

4. The binding component according to claim 1, wherein each of the first fitting convex portion and the second fitting convex portion has a shape and a size so that the first fitting convex portion and the second fitting convex portion are configured to be fitted into a clearance, the clearance being formed between adjacent binding components which are stacked in a stack direction in a state where the first ring arm portion and the second ring arm portion in each binding component are open and a plurality of binding components are stacked in the stack direction.

5. The binding component according to claim 1, wherein at least two slits are provided in the ring parts which are located, at least, at both ends in an extension direction of the back part, each slit being formed in the ring back portion by an opening which penetrates an inner peripheral side and an outer peripheral side of the ring back portion.

* * * * *